US008023864B2

(12) United States Patent
Takagi et al.

(10) Patent No.: US 8,023,864 B2
(45) Date of Patent: Sep. 20, 2011

(54) TONER CARTRIDGE AND DEVELOPING APPARATUS

(75) Inventors: Takeyuki Takagi, Nagoya (JP); Hiroki Mori, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 506 days.

(21) Appl. No.: 12/109,712

(22) Filed: Apr. 25, 2008

(65) Prior Publication Data

US 2008/0267658 A1 Oct. 30, 2008

(30) Foreign Application Priority Data

Apr. 27, 2007 (JP) ..... 2007-119087
Apr. 27, 2007 (JP) ..... 2007-119088

(51) Int. Cl.
*G03G 15/00* (2006.01)
*G03G 15/08* (2006.01)

(52) U.S. Cl. ..... 399/262; 399/263; 399/103; 399/106; 399/102

(58) Field of Classification Search ..... 399/258, 399/119, 260, 263, 262, 103, 106, 102
See application file for complete search history.

(56) References Cited

U.S. PATENT DOCUMENTS 5,385,181 A * 1/1995 Bhagwat et al. ..... 141/364
5,568,237 A * 10/1996 Ishida et al. ..... 399/263
7,574,161 B2 * 8/2009 Ota ..... 399/258
2005/0196197 A1 * 9/2005 Himes ..... 399/262
2007/0104505 A1 * 5/2007 Murakami et al. ..... 399/106

FOREIGN PATENT DOCUMENTS

| | | |
|---|---|---|
| JP | 09-319214 | 12/1997 |
| JP | 2001-051505 | 2/2001 |
| JP | 2002-341648 | 11/2002 |
| JP | 2003-005500 | 1/2003 |
| JP | 2003-029515 | 1/2003 |
| JP | 2003-084551 | 3/2003 |
| JP | 2004-157254 | 6/2004 |
| JP | 2005-031229 | 2/2005 |
| JP | 2005-121888 | 5/2005 |
| JP | 2005-221866 | 8/2005 |
| JP | 2006-243446 | * 9/2006 |

* cited by examiner

*Primary Examiner* — David Porta
*Assistant Examiner* — Yara Green
(74) *Attorney, Agent, or Firm* — Banner & Witcoff, Ltd.

(57) ABSTRACT

A toner cartridge is described. The toner cartridge may include: a first frame storing a developing agent and having a first opening for passing the developing agent therethrough; a second frame relatively movable with respect to the first frame in a direction orthogonal to a direction of passage of the developing agent through the first opening, and opening/closing the first opening; and a seal member provided on either one of the first frame and the second frame for coming into contact with the other frame to prevent leakage of the developing agent from the first opening. A first edge of the seal member and an edge of the other frame, coming into contact with each other when the second frame opens/closes the first opening, intersect with each other as viewed from the direction of passage.

27 Claims, 15 Drawing Sheets

( a )

( a )
( b )
UPPER SIDE
FRONT SIDE
LEFT SIDE
LOWER SIDE
RIGHT SIDE
REAR SIDE
31

TONER CARTRIDGE AND DEVELOPING APPARATUS

CROSS REFERENCE TO RELATED APPLICATIONS

This application claims priority to Japanese Patent Application No. 2007-119087 and Japanese Patent Application No. 2007-119088 filed on Apr. 27, 2007, the disclosures of which are hereby incorporated into the present application by reference.

TECHNICAL FIELD

The present invention relates to a developing apparatus and a toner cartridge provided on an image forming apparatus such as a laser printer.

BACKGROUND

A toner cartridge provided on an image forming apparatus such as a laser printer for storing a developing agent is known in general.

For example, a double-structure toner box including a container body storing a toner and an outer casing receiving and pivotably supporting the container body is known as such a toner cartridge.

The container body is provided with a toner discharging port, and the outer casing is provided with an opening opposable to the toner discharging port. In this toner box, the toner can be discharged from the container body by pivoting the container body to oppose the discharging port and the opening to each other and open the discharging port. On the other hand, discharge of the toner from the discharging port can be regulated by pivoting the container body to shift the discharging port and the opening from each other and close the discharging port.

A seal member is provided on the outer peripheral surface of the container body, to surround the discharging port. This seal member is in contact with the inner peripheral surface of the outer casing to block the clearance between the container body and the outer casing, thereby preventing leakage of a developing agent from the discharging port.

In this toner box, the seal member is in contact with the inner peripheral surface of the outer casing. When the container body is pivoted for opening/closing the discharging port, therefore, the seal member may be caught by an edge of the opening provided on the outer casing and separated from the container body.

In this toner box, further, the seal member must be regularly in contact with the inner peripheral surface of the outer casing, in order to prevent leakage of the developing agent. If the container body is pivoted in this state, resistance is caused in the pivot of the container body due to friction between the seal member and the inner peripheral surface of the outer casing, and hence the operability related to opening/closing of the discharging port may be reduced.

SUMMARY

One aspect of the present invention may provide a toner cartridge capable of preventing separation of a seal member when opening/closing a first opening, and a developing apparatus to which this toner cartridge is detachably mounted.

Another aspect of the present invention may provide a toner cartridge capable of suppressing reduction of operability related to opening/closing of a first opening while preventing leakage of a developing agent from the first opening, and a developing apparatus to which this toner cartridge is detachably mounted.

The same or different aspect of the present invention may provide a toner cartridge including: a first frame storing a developing agent and having a first opening for passing the developing agent therethrough; a second frame relatively movable with respect to the first frame in a direction orthogonal to a direction of passage of the developing agent through the first opening, and opening/closing the first opening; and a seal member provided on either one of the first frame and the second frame for coming into contact with the other frame to prevent leakage of the developing agent from the first opening, wherein a first edge of the seal member and an edge of the other frame, coming into contact with each other when the second frame opens/closes the first opening, intersect with each other as viewed from the direction of passage.

One or more aspects of the present invention may provide a developing apparatus including a toner cartridge storing a developing agent and a casing to which the toner cartridge is detachably mountable, wherein the toner cartridge includes: a first frame storing the developing agent and having a first opening for passing the developing agent therethrough; a second frame relatively movable with respect to the first frame in a direction orthogonal to a direction of passage of the developing agent through the first opening, and opening/closing the first opening; and a seal member provided on either one of the first frame and the second frame for coming into contact with the other frame to prevent leakage of the developing agent from the first opening, a first edge of the seal member and an edge of the other frame, coming into contact with each other when the second frame opens/closes the first opening, intersect with each other as viewed from the direction of passage, and the casing is formed with a third opening opposed to the first opening and capable of receiving the developing agent.

One or more aspects of the present invention may provide a toner cartridge including: a first frame storing a developing agent and having a first opening for passing the developing agent therethrough; a second frame opening/closing the first opening; and a seal member provided on either one of the first frame and the second frame for coming into contact with the other frame to prevent leakage of the developing agent from the first opening, wherein the first frame has a first edge portion forming the first opening, the seal member includes a first seal portion arranged on the first edge portion when the second frame closes the first opening and a second seal portion arranged on a position separated from the first opening beyond the first seal portion when the second frame closes the first opening, and a contact pressure of the first seal portion to the other frame is higher than a contact pressure of the second seal portion to the other frame.

One or more aspects of the present invention may provide a developing apparatus including a toner cartridge storing a developing agent and a casing to which the toner cartridge is detachably mountable, wherein the toner cartridge includes: a first frame storing the developing agent and having a first opening for passing the developing agent therethrough; a second frame opening/closing the first opening; and a seal member provided on either one of the first frame and the second frame for coming into contact with the other frame to prevent leakage of the developing agent from the first opening, the first frame has a first edge portion forming the first opening, the seal member includes a first seal portion arranged on the first edge portion when the second frame closes the first opening and a second seal portion arranged on a position separated from the first opening beyond the first seal portion when the second frame closes the first opening, a contact pressure of the first seal portion to the other frame is higher than a contact pressure of the second seal portion to the other frame, and the casing is formed with a third opening opposed to the first opening and capable of receiving the developing agent.

BRIEF DESCRIPTION OF THE DRAWINGS

FIG. 2(*b*) is an enlarged view of a principal part shown in FIG. 2(*a*).

FIG. 7(*b*) is a side sectional view of a principal part in an inner passing port of the inner casing shown in FIG. 7(*a*).

FIG. 8(*b*) is a side sectional view of the toner seal.

FIG. 9(*b*) illustrates a state where the toner seals are attached to the inner casing shown in FIG. 7(*b*).

FIG. 10(*b*) is a side sectional view of a principal part in a cartridge-side passing port of the toner cartridge shown in FIG. 10(*a*).

FIG. 11(*b*) is a side sectional view of a principal part in the cartridge-side passing port of the toner cartridge shown in FIG. 11(*a*).

FIG. 12(*b*) is a side sectional view of a principal part in the cartridge-side passing port of the toner cartridge shown in FIG. 12(*a*).

FIG. 14(*b*) is a side sectional view of the toner seal according to the seventh embodiment.

FIG. 15(*b*) is a side sectional view of the toner seal according to the eighth embodiment.

DETAILED DESCRIPTION

Embodiments of one or more aspects of the present invention are now described with reference to the drawings.

First Embodiment

1. Overall Structure of Laser Printer

Figure 1:
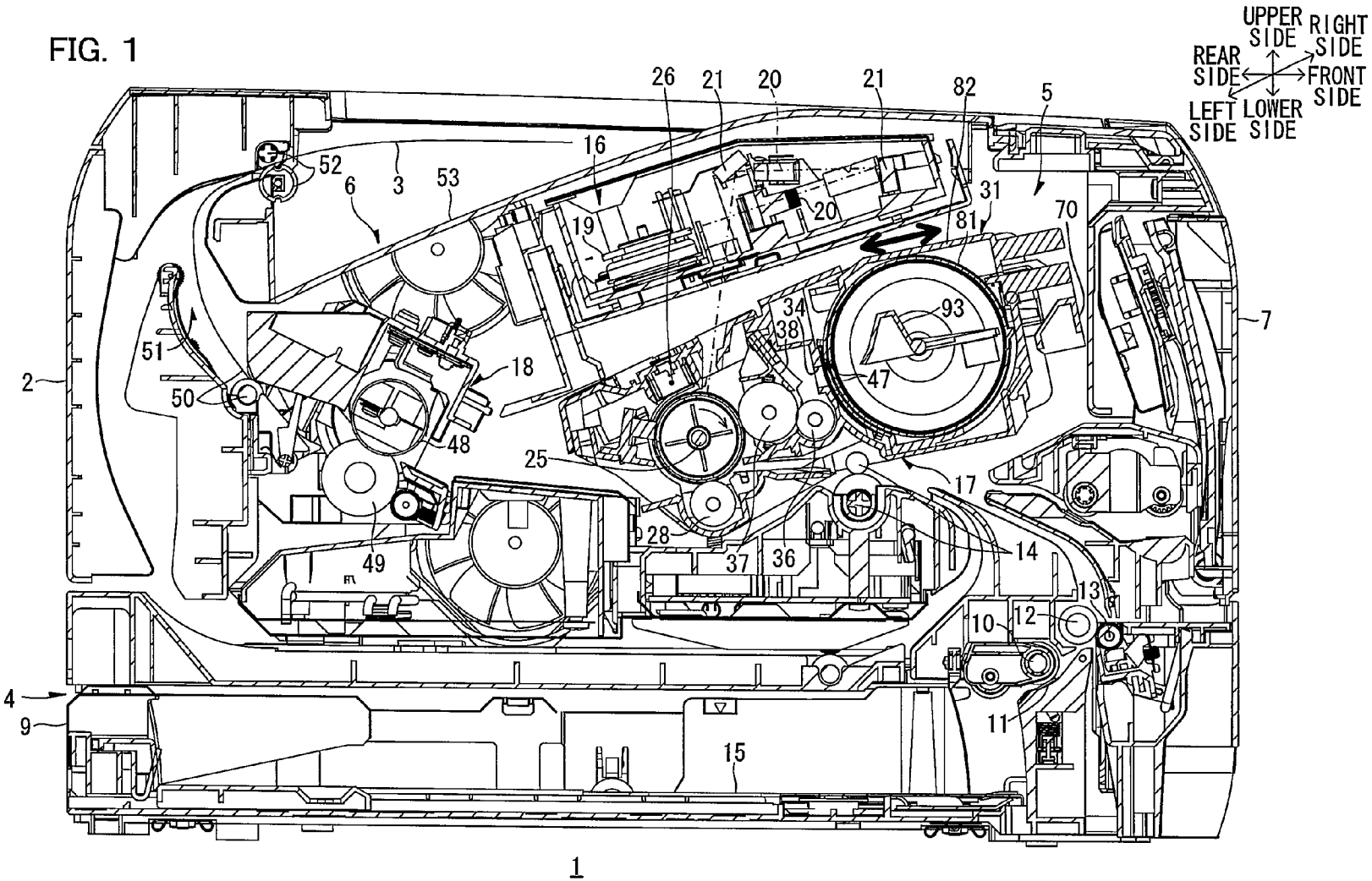
FIG. 1 is a side sectional view showing an illustrative aspect of a laser printer as an example of an image forming apparatus of one or more aspects of the present invention.
Figure 2:
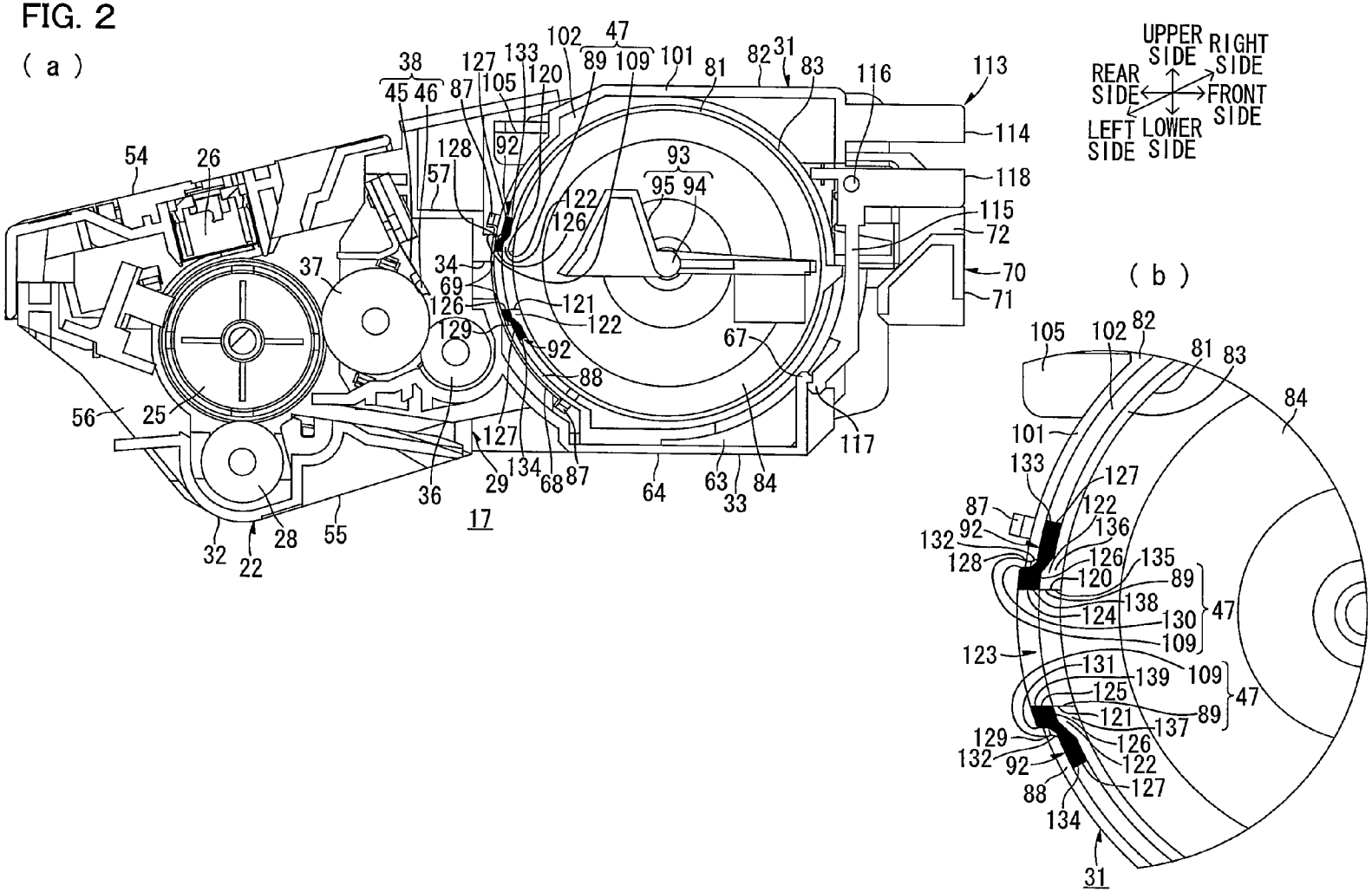
FIG. 2(*a*) is a side sectional view of a process cartridge (mounted with a toner cartridge, with a swinging arm located on a pressing position) of the laser printer shown in FIG. 1.

FIG. 1 is a side sectional view showing an illustrative aspect of a laser printer as an example of an image forming apparatus of one or more aspects of the present invention. FIG. 2(*a*) is a side sectional view of a process cartridge (mounted with a toner cartridge, with a swinging arm located on a pressing position) of the laser printer shown in FIG. 1. FIG. 2(*b*) is an enlarged view showing a principal part of FIG. 2(*a*). FIGS. 2(*a*) and 2(*b*) show toner seals described later in a filled manner, for the convenience of illustration.

This laser printer 1 includes a sheet feeding section 4 for feeding sheets 3 into a main body casing 2, an image forming section 5 for forming images on the fed sheets 3, and a sheet ejecting section 6 ejecting the sheets 3 formed with the images, as shown in FIG. 1.

(1) Main Body Casing

The main body casing 2 is in the form of a box having an opening provided on one sidewall thereof and a front cover 7 for opening/closing this opening. A process cartridge 17 (described later) as an example of a developing apparatus can be attached to/detached from the main body casing 2 along thick arrow shown in FIG. 1 by opening the front cover 7.

In the following description, it is assumed that the side provided with the front cover 7 is the front side (frontal side) and the side opposite thereto is the rear side (back side). It is also assumed that this side of the plane of FIG. 1 is the left side, and the other side of the plane of FIG. 1 is the right side. The right and left direction and the width direction are synonymic to each other. The process cartridge 17 and the toner cartridge 31 are described later with reference to a state where frame-side passing ports 34 and cartridge-side passing ports 47 described later are generally horizontally directed.

(2) Sheet Feeding Section

The sheet feeding section 4 includes a sheet feeding tray 9, a sheet feeding roller 10, a sheet feeding pad 11, sheet dust removing rollers 12 and 13, registration rollers 14 and a sheet pressing plate 15. The sheets 3 provided on the uppermost position of the sheet pressing plate 15 are fed one by one by the sheet feeding roller 10 and the sheet feeding pad 11 to pass through the rollers 12 to 14, and thereafter transported to a transfer position (described later) of the image forming section 5.

(3) Image Forming Section

The image forming section 5 includes a scanning unit 16, the process cartridge 17 and a fixing section 18.

(3-1) Scanning Unit

The scanning unit 16 is provided on an upper portion in the main body casing 2, and includes a laser emission portion (not shown), a rotationally driven polygonal mirror 19, a plurality of lenses 20 and a plurality of reflecting mirrors 21. A laser beam emitted from the laser portion section on the basis of image data is reflected by the polygonal mirror 19 and passes through or is reflected by the plurality of lenses 20 and the plurality of reflecting mirrors 21, for scanning the surface of a photosensitive drum 25 (described later) of the process cartridge 17, as shown by a dashed-dotted line.

(3-2) Process Cartridge

The process cartridge 17 is arranged under the scanning unit 16 in the main body casing 2, and detachably mounted to the main body casing 2.

The process cartridge 17 includes a process frame 22 as an example of a casing provided with a transfer path 29 allowing passage of the sheets 3, and the toner cartridge 31 detachably mounted to a cartridge receiving area 33 (described later) of the process frame 22, as shown in FIG. 2(*a*).

The process frame 22 is provided with a partition wall 57 extending in the up and down direction on a generally central position in the anteroposterior direction thereof. In the process frame 22, a developing area 32 is provided on the rear side of the partition wall 57, and the aforementioned cartridge receiving area 33 is provided on the front side of the partition wall 57. The partition wall 57 is provided with the frame-side passing ports 34 as an example of the third openings.

The developing area 32 includes the photosensitive drum 25, a scorotron charger 26, a transfer roller 28, a feed roller 36, a developing roller 37 and a layer-thickness regulating blade 38.

The photosensitive drum 25 is rotatably supported by the process frame 22. The scorotron charger 26 is supported by the process frame 22 on a position above the photosensitive drum 25 at an interval from the photosensitive drum 25. The transfer roller 28 is opposed to the photosensitive drum 25 from below the photosensitive drum 25, and rotatably supported by the process frame 22. The developing roller 37 is opposed to the front side of the photosensitive drum 25. The feed roller 36 is opposed to the front side of the developing roller 37. The developing roller 37 and the feed roller 36 are rotatably supported by the process frame 22. The layer-thickness regulating blade 38 includes a leaf spring member 45 in the form of a thin plate and a pressure contact rubber 46 provided on the lower end portion of the leaf spring member 45. The upper end portion of the leaf spring member 45 is fixed to the process frame 22, and the pressure contact rubber 46 presses the surface of the developing roller 37 with the elastic force of the leaf spring member 45.

The toner cartridge 31 is detachably mounted to the process frame 22 in the cartridge receiving area 33. The toner cartridge 31 is generally in the form of a cylinder. The toner cartridge 31 is provided with the cartridge-side passing ports 47 for making the inner side and the outer side communicate with each other.

An agitator 93 is rotatably provided in the toner cartridge 31. The toner cartridge 31 stores a nonmagnetic one-component positively chargeable toner as an example of the developing agent.

The toner stored in the toner cartridge 31 is agitated by rotation of the agitator 93, received in the frame-side passing ports 34 from the cartridge-side passing ports 47, and discharged into the developing area 32. The discharged toner is fed to the feed roller 36.

The toner fed to the feed roller 36 is fed to the developing roller 37 through rotation of the feed roller 36. At this time, the toner is frictionally charged to positive polarity between the feed roller 36 and the developing roller 37. Then, the toner fed to the developing roller 37 enters the space between the pressure contact rubber 46 and the developing roller 37 following rotation of the developing roller 37, and is carried on the surface of the developing roller 37 as a thin layer, the thickness of which is regulated between the pressure contact rubber 46 and the developing roller 37.

The surface of the photosensitive drum 25 is first uniformly positively charged by the scorotron charger 26 following rotation of the photosensitive drum 25, and thereafter exposed by the laser beam from the scanning unit 16, to form an electrostatic latent image based on the image data. Then, the toner carried on the surface of the develop; roller 37 is fed to the electrostatic latent image formed on the surface of the photosensitive drum 25 when opposedly coming into contact with the photosensitive drum 25 due to rotation of the developing roller 37. Thus, the electrostatic latent image is developed (visualized) and a toner image is carried on the surface of the photosensitive drum 25. This toner image is transferred onto the sheet 3 transported to the space (transfer position) between the photosensitive drum 25 and the transfer roller 28 in the transfer path 29.

(3-3) Fixing Section

The fixing section 18 is provided at the back of the process cartridge 17, as shown in FIG. 1. The fixing section 18 includes a heating roller 48, a pressure roller 49 pressed against the heating roller 48 from below, and a pair of transport rollers 50 arranged at the back of these rollers 48 and 49.

The fixing section 18 thermally fixes the toner transferred to the sheet 3 on the transfer position while the sheet 3 passes through the space between the heating roller 48 and the pressure roller 49. Thereafter the pair of transport rollers 50 transport this sheet 3 to the sheet ejecting section 6.

(4) Sheet Ejecting Section

The sheet ejecting section 6 includes a sheet ejecting transport path 51, a sheet ejecting rollers 52 and a sheet ejection tray 53. The sheet 3 transported from the fixing section 18 to the sheet ejecting transport path 51 is further transported from the sheet ejecting transport path 51 to the sheet ejecting rollers 52, and ejected onto the sheet ejection tray 53 by the sheet ejecting rollers 52.

2. Details of Process Cartridge

Figure 3:
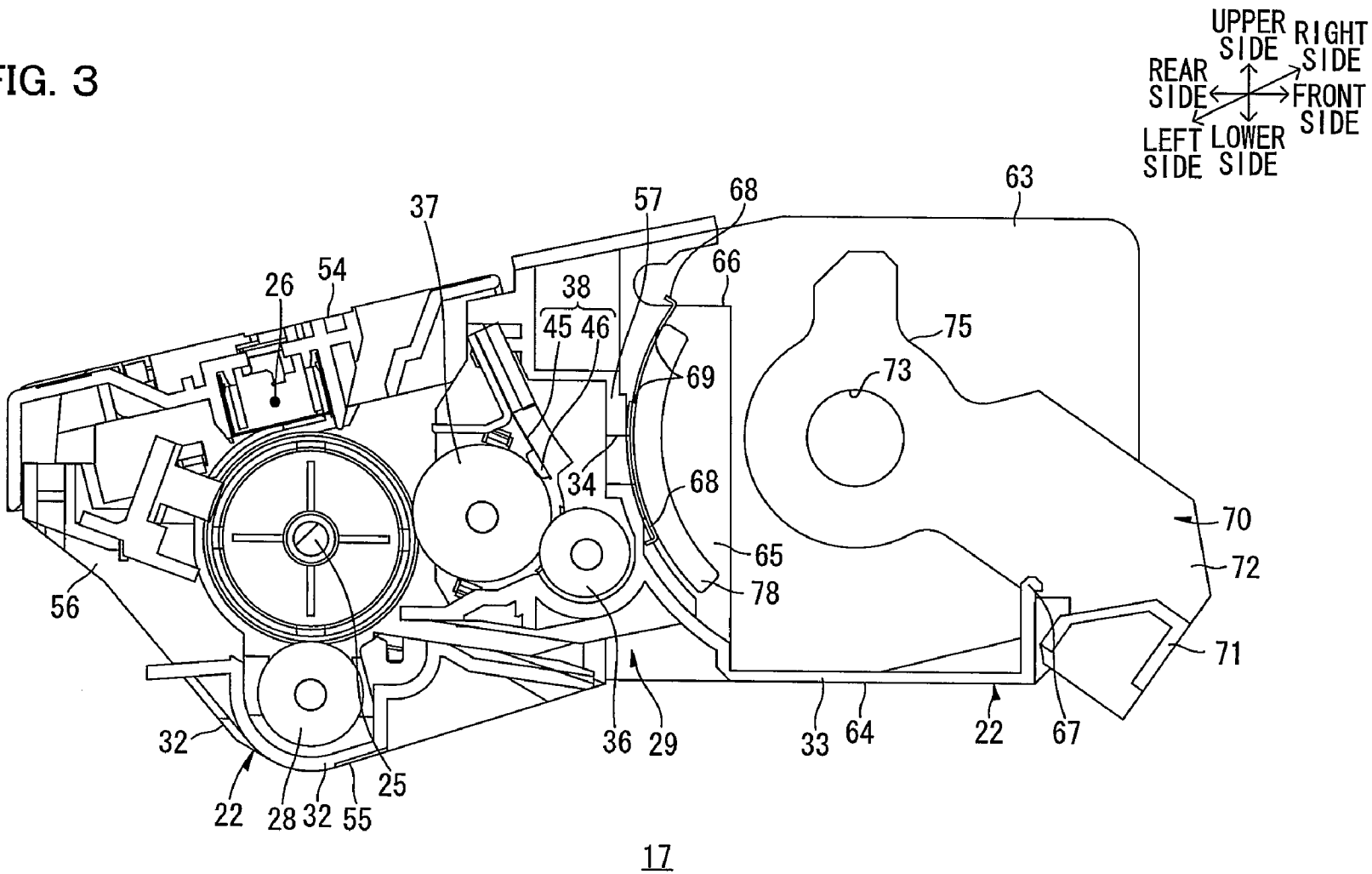
FIG. 3 is a side sectional view of the process cartridge (with the toner cartridge detached, and with the swinging arm located on a pressing cancellation position) of the laser printer shown in FIG. 1.
Figure 4:
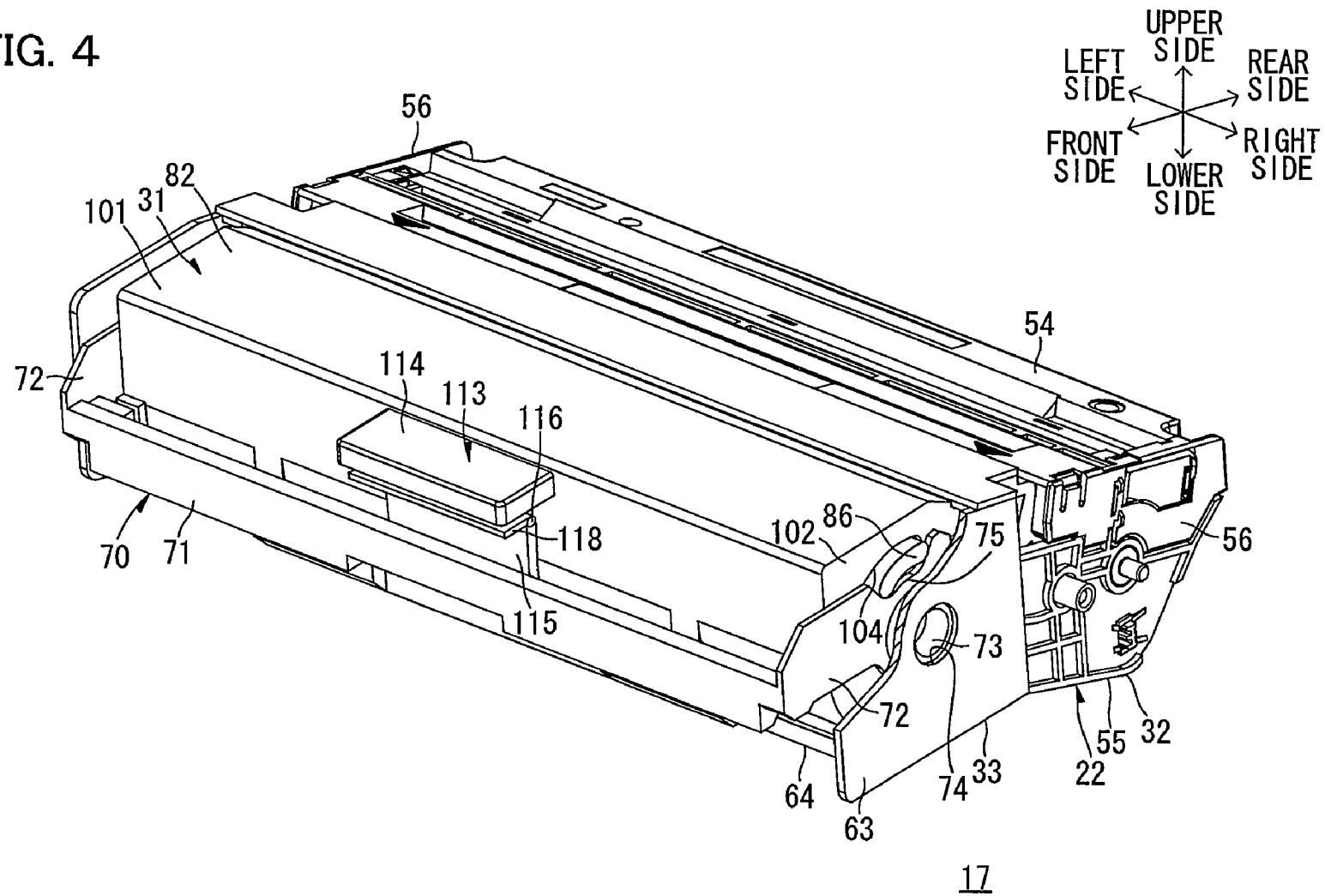
FIG. 4 is a partially omitted perspective view of the process cartridge as viewed obliquely from the front right side.
Figure 5:
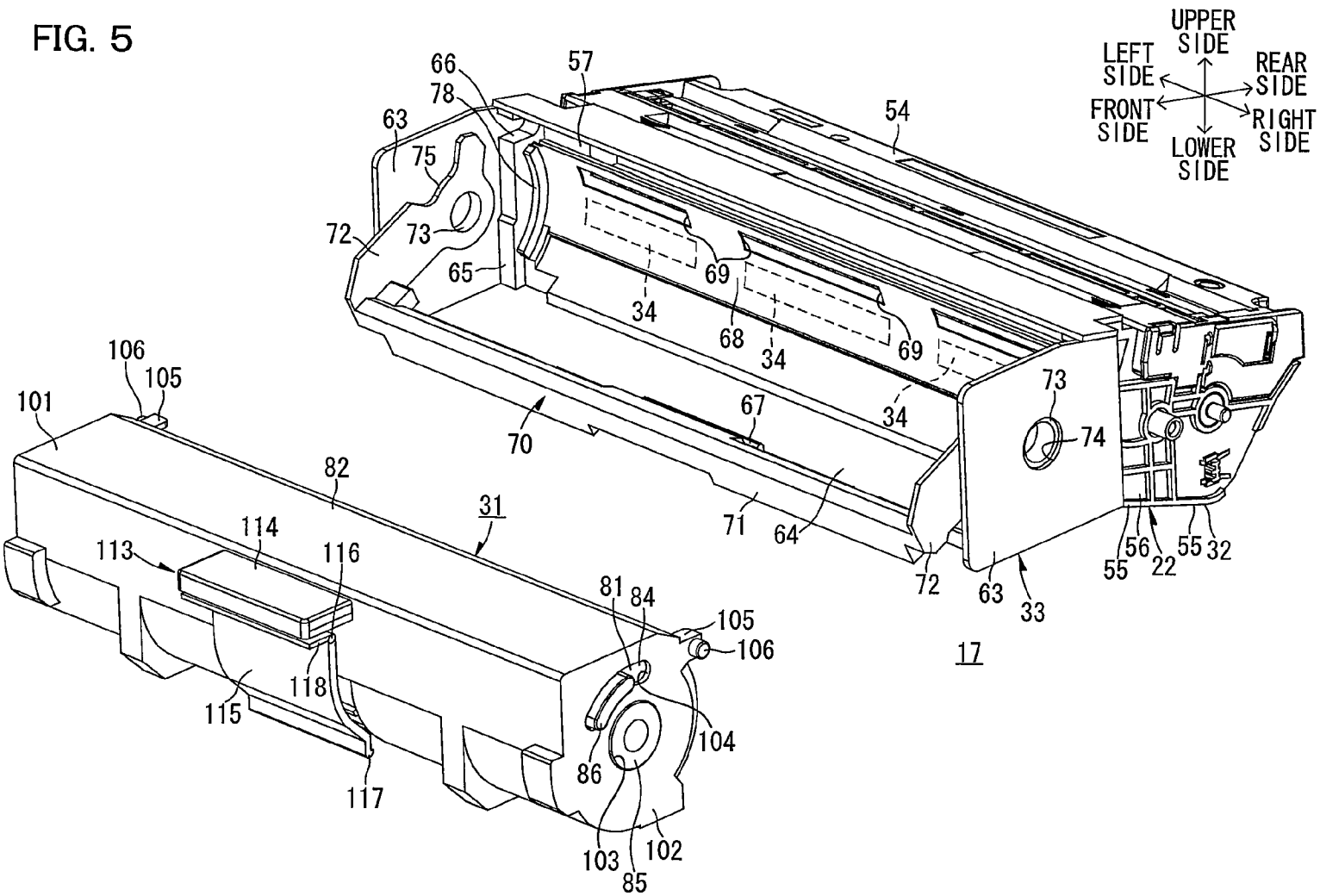
FIG. 5 is an exploded perspective view of the process cartridge as viewed obliquely from the front right side.
Figure 6:
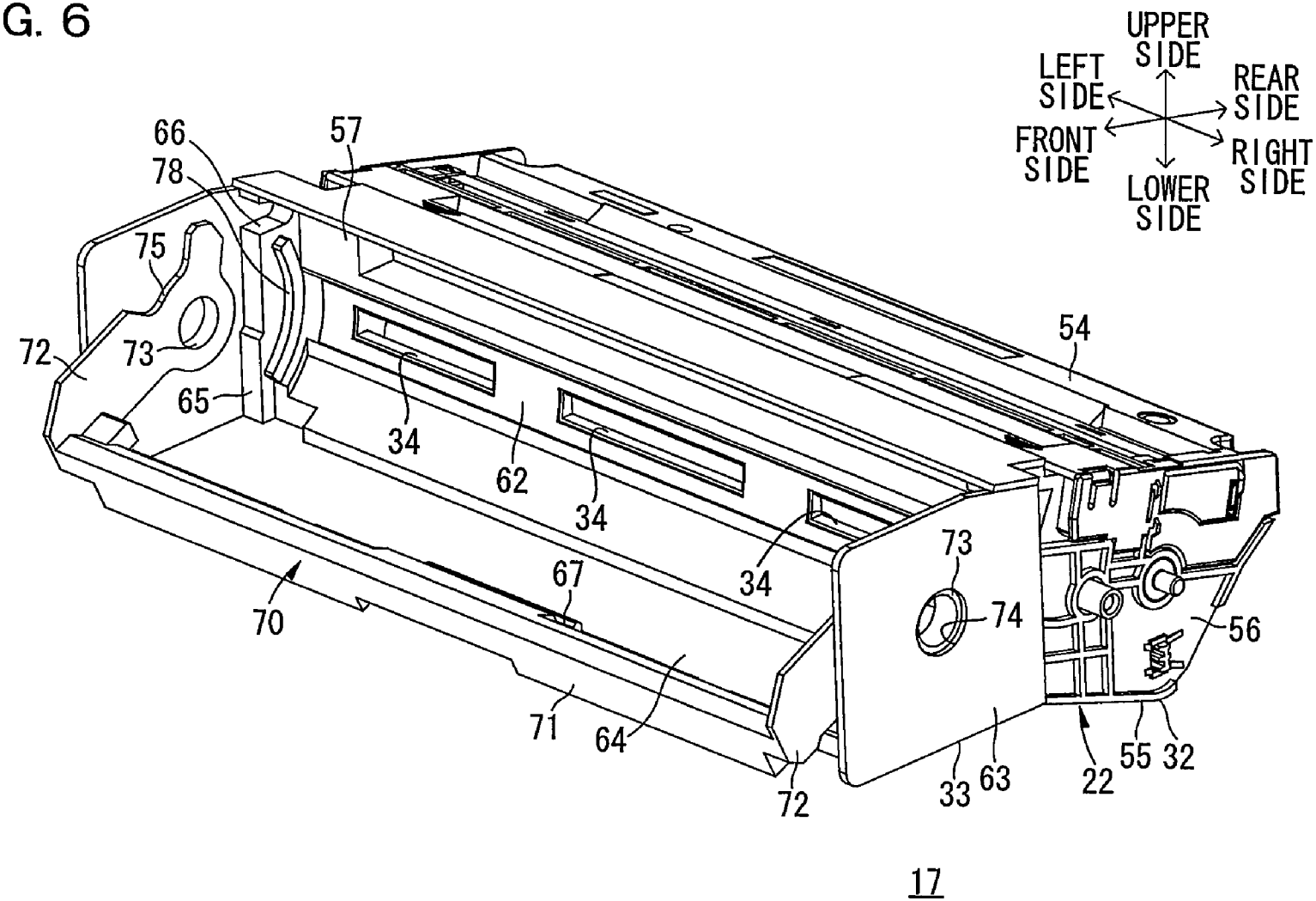
FIG. 6 is a perspective view of the process cartridge (with the toner cartridge detached) omitting a shutter.

FIG. 3 is a side sectional view of the process cartridge (with the toner cartridge detached, and with the swinging arm located on a pressing cancellation position) of the laser printer shown in FIG. 1. FIG. 4 is a partially omitted perspective view of the process cartridge as viewed obliquely from the front right side. FIG. 5 is an exploded perspective view of the process cartridge as viewed obliquely from the front right side. FIG. 6 is a perspective view of the process cartridge (with the toner cartridge detached) omitting a shutter.

(1) Process Frame

The process frame 22 integrally includes the aforementioned developing area 32 and the cartridge receiving area 33, as shown in FIG. 3.

(1-1) Developing Area

The developing area 32 integrally includes an upper wall 54, a bottom wall 55, both side walls 56 and the aforementioned partition wall 57, as shown in FIGS. 3 and 4. The side walls 56 are opposed to each other at an interval in the width direction. Each side wall 56 is arranged along the anteroposterior direction.

The developing roller 37 is rotatably supported by the front portions of the side walls 56, to be supported on the process frame 22.

The feed roller 36 is rotatably supported by the front portions of the side walls 56 on the front side of the developing roller 37, to be supported on the process frame 22.

As shown in FIG. 3, the partition wall 57 is provided with a curved portion along the outer peripheral surface of the toner cartridge 31 on an intermediate position in the up and down direction.

As shown in FIG. 6, the aforementioned frame-side passing ports 34 are provided on the curved portion of the partition wall 57.

More specifically, three frame-side passing ports 34 are provided at intervals in the width direction. Each frame-side passing port 34 is generally in the form of a rectangle elongated in the width direction.

The curved portion of the partition wall 57 is also provided with a frame seal 62 for preventing leakage of the toner from the frame-side passing ports 34.

The frame seal 62 is made of an elastic material such as felt in the form of a strip extending in the width direction, and provided with cutouts corresponding to the frame-side passing ports 34 respectively. The frame seal 62 is attached along the width direction so that the cutouts are opposed to the frame-side passing ports 34 respectively.

Thus, the frame seal 62 is provided on the surface (front surface) of the curved portion of the partition wall 57, to cover the peripheral edge portions of the frame-side passing ports 34 and to be continuous between the adjacent frame-side passing ports 34. The frame seal 62 is shown only in FIG. 6, for the convenience of illustration.

(1-2) Cartridge Receiving Area

The cartridge receiving area 33 includes both side plates 63 and a bottom plate 64, as shown in FIG. 5. The side plates 63 and the bottom plate 64 are continuous and integrally formed with the side walls 56 and the bottom wall 55 of the developing area 32 respectively.

Shutter support portions 65 are provided on width-directional inner side surfaces of the side plates 63 respectively. The shutter support portions 65 are generally in the form of rectangles inwardly swelling from the width-directional inner side surfaces of the side plates 63, to vertically extend on the rear end portions of the side plates 63.

Shutter guide portions 78 are respectively provided on the width-directional inner side surfaces of the shutter support portions 65. The shutter guide portions 78 are in the form of projections inwardly swelling from the width-directional inner side surfaces of the shutter support portions 65, and opposed to the curved portion of the partition wall 57 at a slight interval in the anteroposterior direction. The shutter guide portions 78 are curved with a curvature generally identical to that of the curved portion of the partition wall 57.

The upper end surfaces of the shutter support portions 65 are located slightly downward of the upper end edges of the corresponding side plates 63. The upper end surfaces of the shutter support portions 65 form upper fixing portions 66.

The bottom plate 64 is provided with a lower fixing portion 67 slightly projecting frontward from the width-directional center of the front end edge thereof.

The cartridge receiving area 33 is provided with a shutter 68 opening/closing the frame-side passing ports 34. The shutter 68 is regarded as a part of the process frame 22. In other words, the shutter 68 is also regarded as an example of the casing.

The shutter 68 is generally in the form of a rectangle extending in the width direction, and curved with a curvature generally identical to that of the curved portion of the partition wall 57. The shutter 68 is so formed as to extend between the shutter guide portions 78 in the width direction and to extend slightly shorter than the shutter guide portions 78 in the up and down direction. The shutter 68 is provided with three shutter openings 69 correspondingly opposable to the frame-side passing ports 34 respectively. The shutter openings 69 function as an example of the third openings.

As shown in FIG. 3, the shutter 68 is opposed to the curved portion of the partition wall 57, and both width-directional end portions thereof are slidably sandwiched between the partition wall 57 and the respective shutter guide portions 78.

Thus, the shutter 68 is supported to be swingable in the up and down direction between an opening position (see FIG. 2) for opening the frame-side passing ports 34, and a closing position (see FIGS. 3 and 5) for closing the frame-side passing ports 34 along the shutter guide portions 78. When the shutter 68 is on the opening position, each frame-side passing port 34 is opposed to the corresponding shutter opening portion 69 and opened toward the outer side (front side), as shown in FIG. 2(*a*). When the shutter 68 is on the closing position, on the other hand, each frame-side passing port 34 is closed from the front side by a portion of the shutter 68 located downward of the corresponding shutter opening 69, as shown in FIG. 3.

As shown in FIG. 5, the cartridge receiving area 33 is provided with the swinging arm 70. The swinging arm 70 is generally U-shaped in plan view. The swinging arm 70 integrally includes a grasp bar 71 extending in the width direction and arm side plates 72 respectively extending rearward from both width-directional end portions of the grasp bar 71.

A boss 73 projecting outward in the width direction is provided on the rear end portion of each arm side plate 72. Each boss 73 is rotatably supported in a round hole 74 provided in the corresponding side plate 63.

A downwardly notched receiving recess 75 is provided on the upper edge of the rear end portion of each arm side plate 72.

The swinging arm 70 swings about the boss 73 of each arm side plate 72 between the pressing cancellation position (see FIGS. 3, 5 and 6) where the lower end edge of each arm side plate 72 comes into contact with the front end edge of the bottom plate 64, and the pressing position (see FIGS. 2(*a*), 2(*b*) and 4) for pressing the toner cartridge 31 from the front side when the toner cartridge 31 is received in the cartridge receiving area 33.

(2) Toner Cartridge

Figure 7:
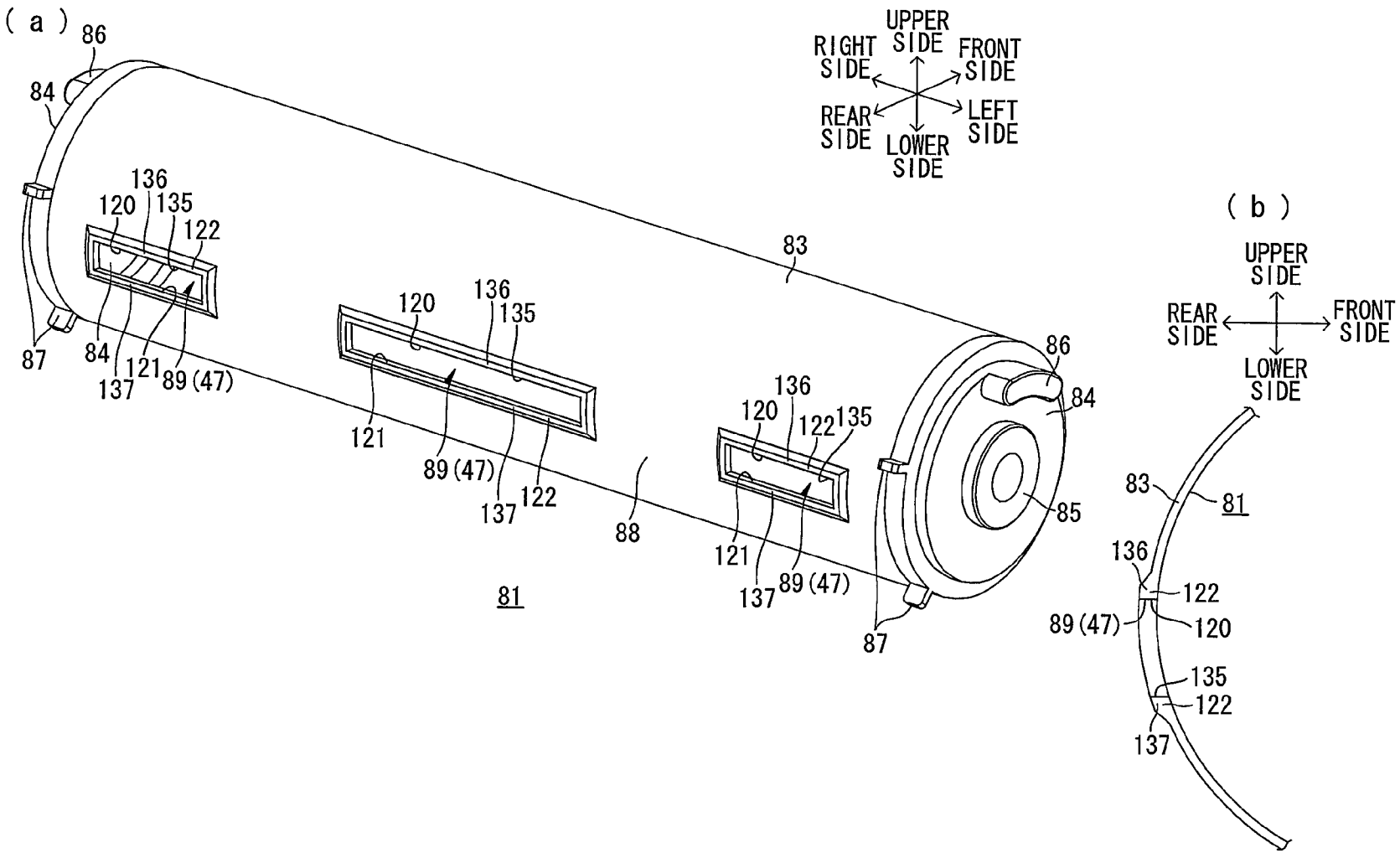
FIG. 7(*a*) is a perspective view of an inner casing (not yet attached with toner seals) of the toner cartridge as viewed obliquely from the rear left side.
Figure 8:
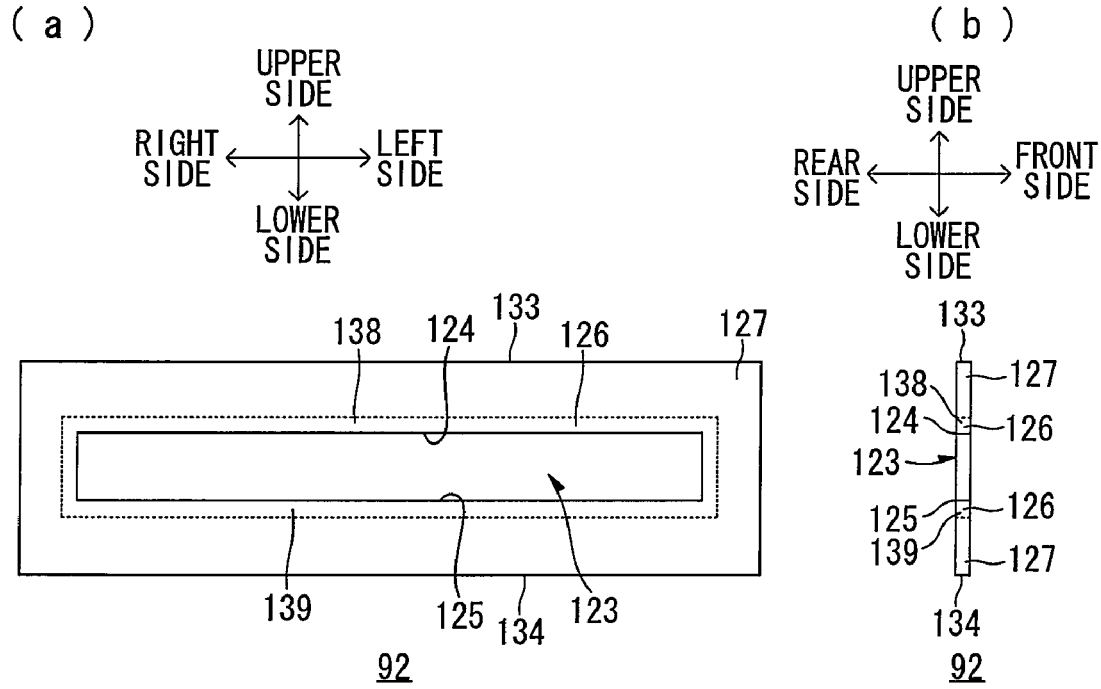
FIG. 8(*a*) is a rear elevational view of a toner seal.
Figure 9:
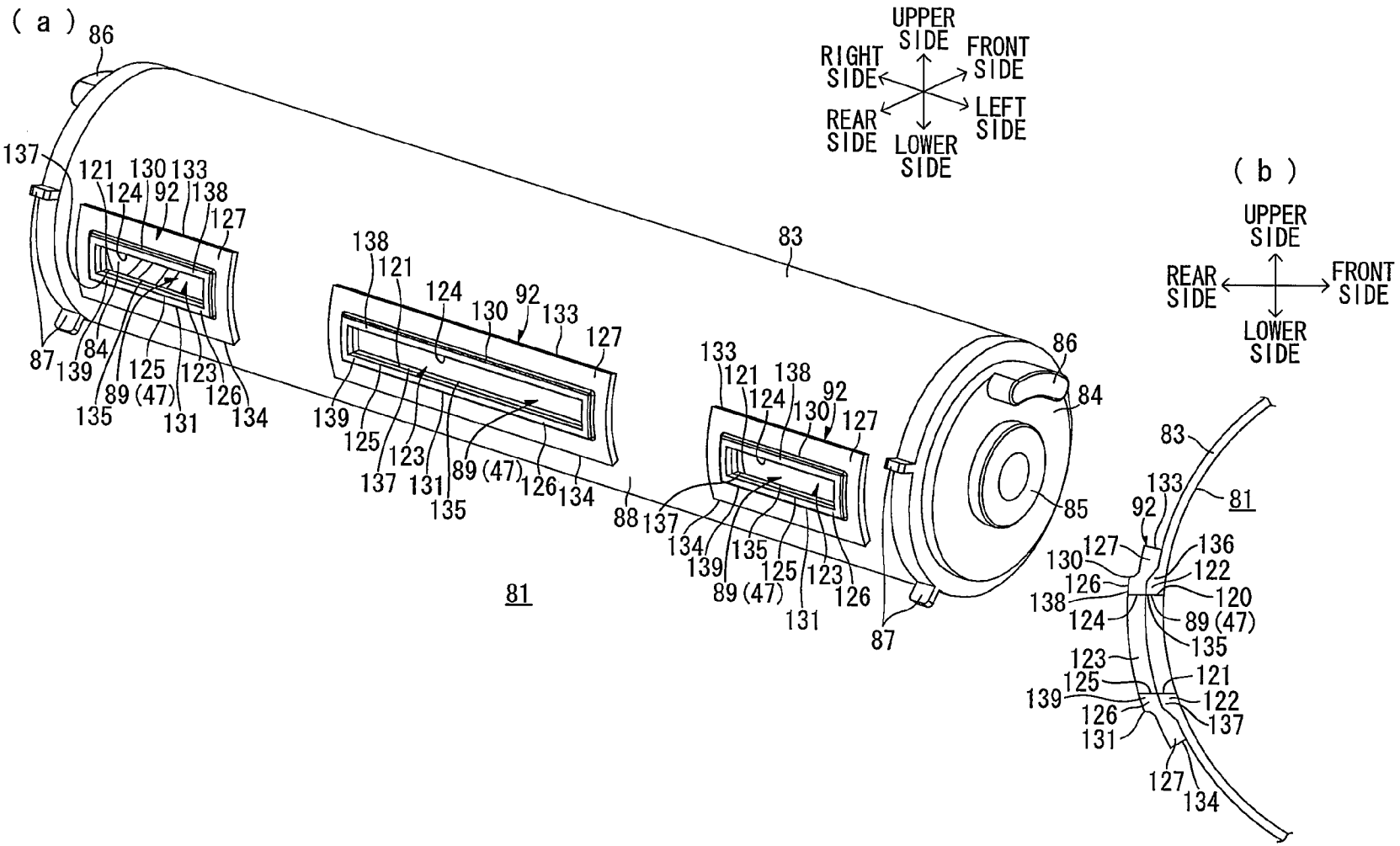
FIG. 9(*a*) illustrates a state where the toner seals are attached to the inner casing shown in FIG. 7(*a*).
Figure 10:
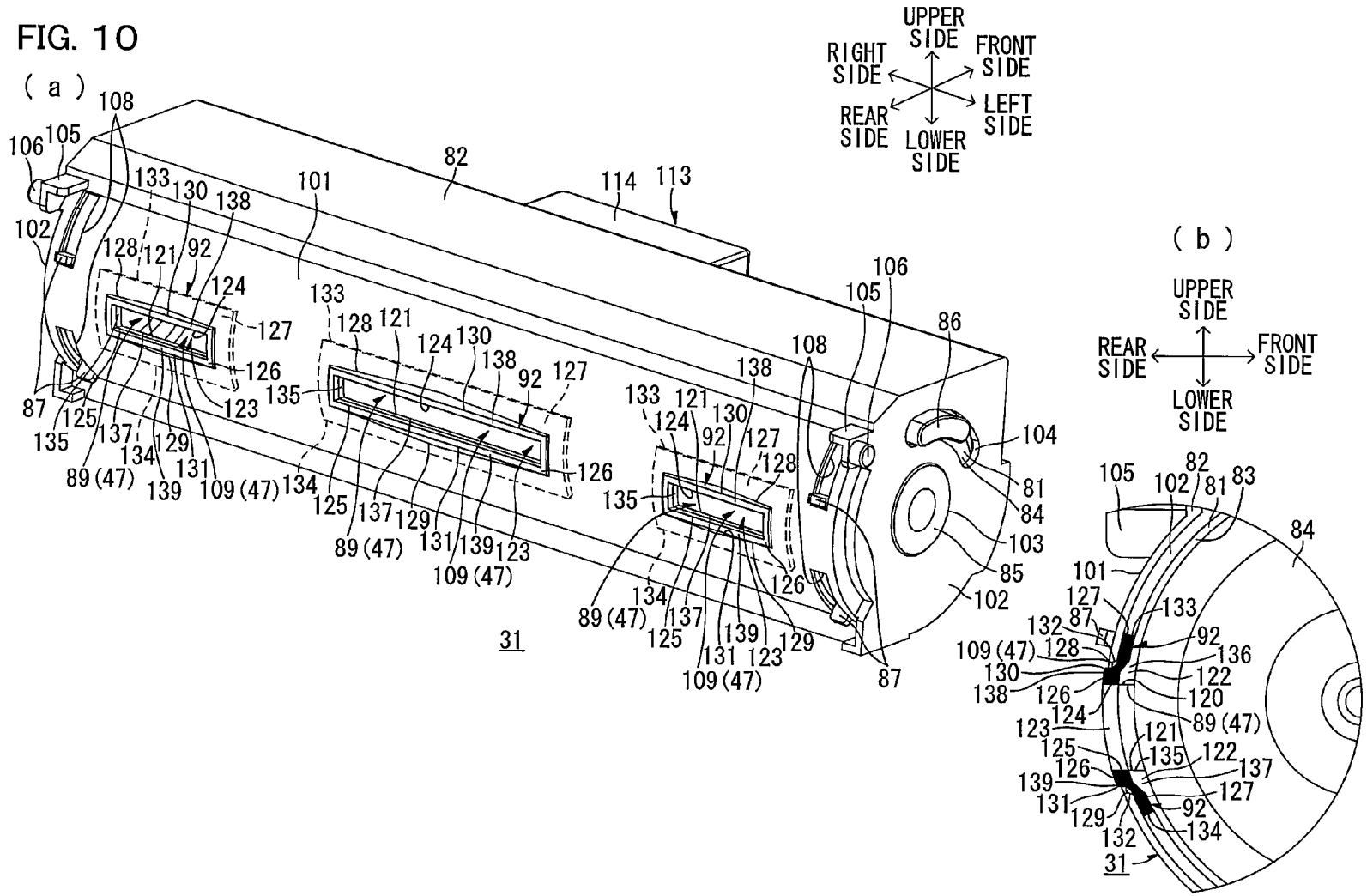
FIG. 10(*a*) is a perspective view of the toner cartridge (with the inner casing located on an open position) as viewed obliquely from the left rear side.
Figure 11:
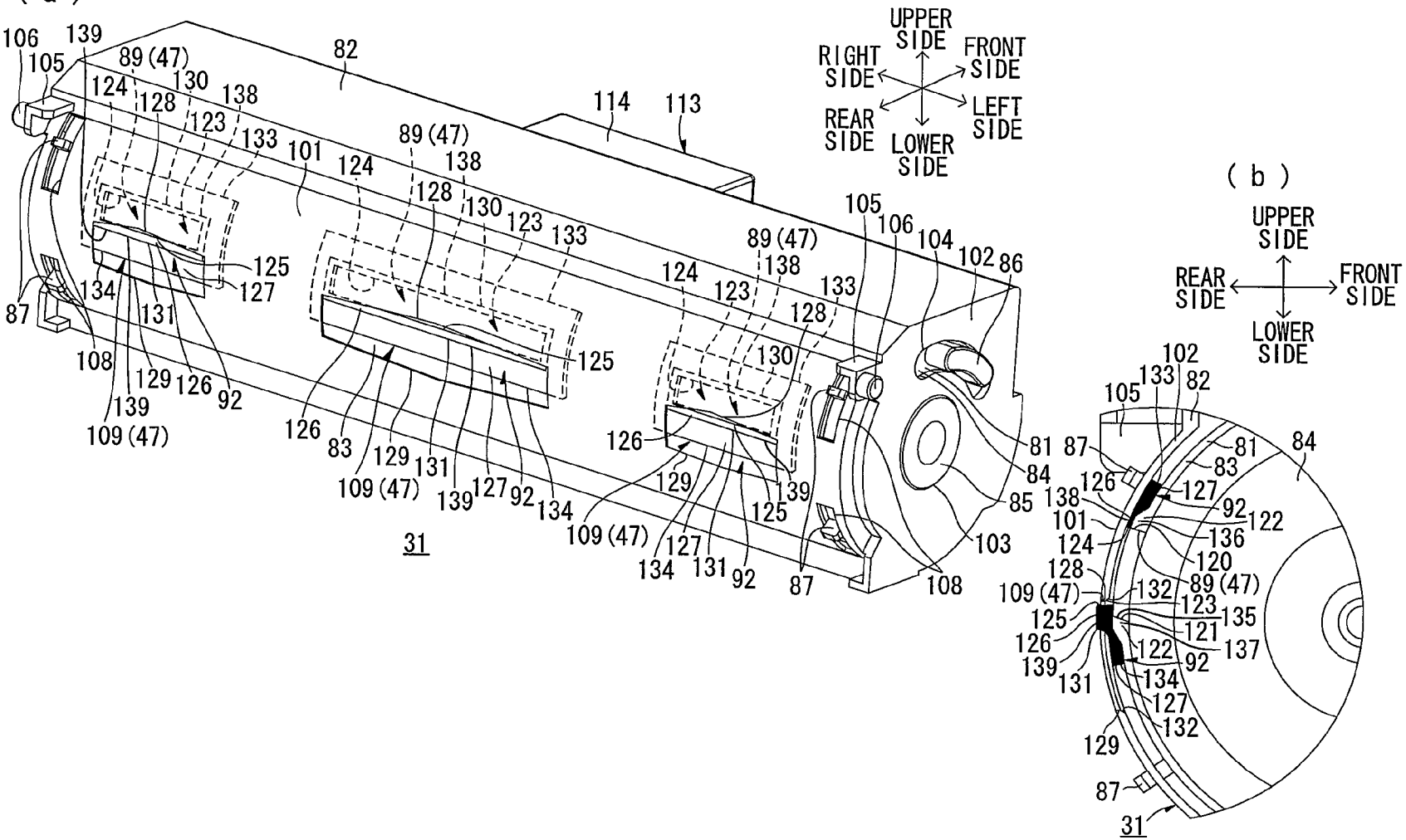
FIG. 11(*a*) is a perspective view of the toner cartridge (with the inner casing located between the open position and a closed position) as viewed obliquely from the rear left side.
Figure 12:
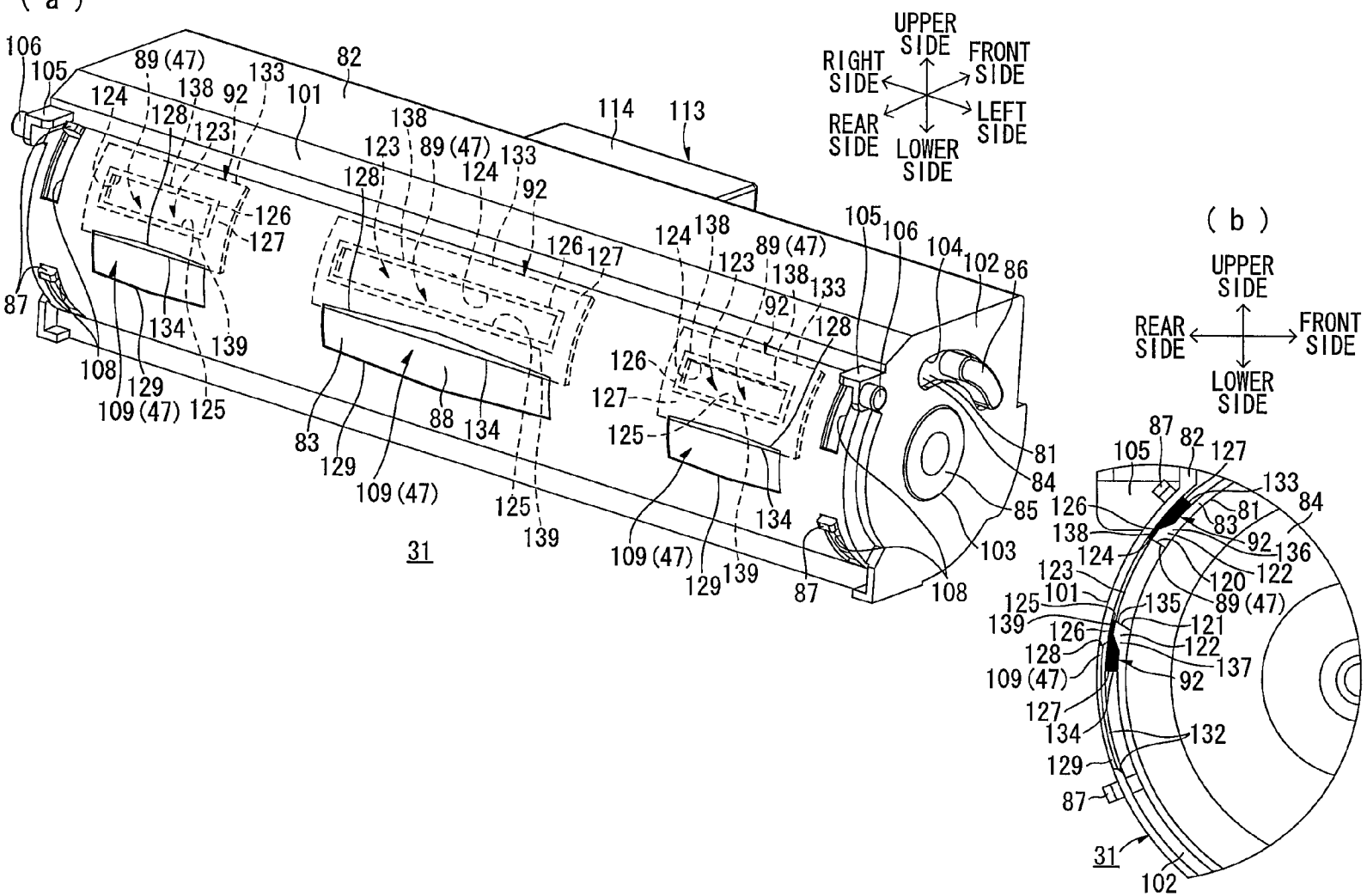
FIG. 12(*a*) is a perspective view showing the toner cartridge (with the inner casing located on the closed position) as viewed obliquely from the rear left side.

FIG. 7(*a*) is a perspective view of an inner casing (not yet attached with toner seals) of the toner cartridge as viewed obliquely from the rear left side. FIG. 7(*b*) is a side sectional view of a principal part in an inner passing port of the inner casing shown in FIG. 7(*a*). FIG. 8(*a*) is a rear elevational view of the toner seal. FIG. 8(*b*) is a side sectional view of the toner seal. FIG. 9(*a*) illustrates a state where the toner seals are attached to the inner casing shown in FIG. 7(*a*). FIG. 9(*b*) illustrates a state where the toner seals are attached to the inner casing shown in FIG. 7(*b*). FIG. 10(*a*) is a perspective view of the toner cartridge (with the inner casing located on an open position) as viewed obliquely from the left rear side. FIG. 10(*b*) is a side sectional view of a principal part in the cartridge-side passing port of the toner cartridge shown in FIG. 10(*a*). FIG. 11(*a*) is a perspective view of the toner cartridge (with the inner casing located between the open position and a closed position) as viewed obliquely from the rear left side. FIG. 11(*b*) is a side sectional view of a principal part in the cartridge-side passing port of the toner cartridge shown in FIG. 11(*a*). FIG. 12(*a*) is a perspective view showing the toner cartridge (with the inner casing located on the closed position) as viewed obliquely from the rear left side. FIG. 12(*b*) is a side sectional view of a principal part in the cartridge-side passing port of the toner cartridge shown in FIG. 12(*a*). FIGS. 10(*b*), 11(*b*) and 12(*b*) show the toner seals in a filled manner, for the convenience of illustration.

As shown in FIGS. 7(*a*) to 12(*b*), the toner cartridge 31 includes an inner casing 81 as an example of a first frame storing the toner and an outer casing 82 as an example of a second frame receiving the inner casing 81.

(2-1) Inner Casing

The inner casing 81 integrally includes a cylindrical inner peripheral wall 83 extending in the width direction and a pair of discoidal inner side walls 84 closing both width-directional end portions of the inner peripheral wall 83, as shown in FIG. 7(*a*).

The inner side walls 84 are respectively provided with thick discoidal boss portions 85 swelling in the width direction from the centers thereof.

The inner side walls 84 are further respectively provided with sliding projections 86 on upper portions thereof radially outward of the boss portions 85. The sliding projections 86 are arcuately formed (with a center angle of about 60°) along the outer peripheral surfaces of the inner side walls 84, to project outward from the inner side walls 84 in the width direction.

The inner side walls 84 are further provided with pairs of sandwiching projections 87 radially projecting from the peripheral end surfaces of the rear sides thereof respectively. The pair of sandwiching projections 87 are arranged at an interval (corresponding to the peripheral length of the shutter 68) from each other in the circumferential direction on the peripheral end surface of the inner side wall 84.

The inner peripheral wall 83 is provided with inner passing ports 89 partially forming the cartridge-side passing ports 47 in a surrounded portion 88 surrounded by the pairs of (four) sandwiching projections 87 arranged on both width-directional sides. The inner passing ports 89 function as an example of first openings.

The inner passing ports 89 are formed on an upper portion of the surrounded portion 88. More specifically, three inner passing ports 89 are formed at intervals in the width direction correspondingly to the three frame-side passing ports 34 (see FIG. 6). In image formation, each inner passing port 89 is opposed to the frame-side passing port 34 (see FIG. 6) located on the corresponding position in the width direction.

Each inner passing port 89 is generally in the form of a rectangle elongated in the width direction in rear elevational view. The length of the inner passing port 89 positioned at the width-directional center is about twice that of the remaining inner passing ports 89. In an edge (referred to as an inner-side edge 135 as an example of the edge of the first opening and a first edge portion) forming each inner passing port 89 on the inner peripheral wall 83, the upper portion is referred to as an inner-side upper edge 120, and the lower portion is referred to as an inner-side lower edge 121. The inner-side upper edge 120 and the inner-side lower edge 121 parallelly extend along the width direction at an interval from each other in the up and down direction (circumferential direction of the inner side wall 83).

On the outer peripheral surface of the inner peripheral wall 83, a projection 122 is provided on each inner-side edge 135. The projection 122 is provided along the entire periphery of the inner-side edge 135, to radially project outward (rearward in FIGS. 7(*a*) and 7(*b*)) from the inner peripheral wall 83 (see FIG. 7(*b*)). More specifically, each projection 122 provided correspondingly to each inner passing port 89 is generally in the form of a rectangle edging the corresponding inner passing port 89 in rear elevational view (as viewed from the outer side in the radial direction). The downstream-side end surface (rear end surface in FIGS. 7(*a*) and 7(*b*)) of the projection 122 in the projecting direction is generally planar. An end edge of the rear end surface of the projection 122 separated from the inner passing port 89 and the inner peripheral wall 83 are linked with each other by an inclined surface inclined with respect to both of the rear end surface of the projection 122 and the inner peripheral wall 83 (see FIG. 7(*b*)). A portion of the projection 122 located above the inner passing port 89 is referred to as a projection upper portion 136, and a portion of the projection 122 located under the inner passing port 89 is referred to as a projection lower portion 137. The projection upper portion 136 and the projection lower portion 137 parallelly extend along the width direction with the inner passing port 89 sandwiched therebetween.

As shown in FIGS. 9(*a*) and 9(*b*), the toner seal 92 as an example of a seal member is attached to the upper portion of the surrounded portion 88 for preventing leakage of the toner from the inner passing port 89 at each inner-side edge 135.

As shown in FIGS. 8(*a*) and 8(*b*), each toner seal 92 is made of an elastic material such as felt in the form of a strip rectangularly elongated in the width direction in rear elevational view with a generally uniform length in the anteroposterior direction (thickness). In an edge forming the outer periphery of the toner seal 92, an upper portion is referred to as a seal outer-peripheral upper edge 133, and a lower portion is referred to as a seal outer-peripheral lower edge 134. The seal outer-peripheral lower edge 134 functions as an example of the first edge. The seal outer-peripheral upper edge 133 and the seal outer-peripheral lower edge 134 parallelly extend along the width direction at an interval from each other in the up and down direction. The toner seal 92 is provided with a notched portion 123 anteroposteriorly passing through the toner seal 92 on a generally central position in rear elevational view correspondingly to each inner passing port 89. The notched portion 123 is generally in the form of a rectangle generally equal in size to the corresponding inner passing port 89 in rear elevational view. In an edge of the toner seal 92 forming the notched portion 123, an upper portion is referred to as a seal inner-side upper edge 124, and a lower portion is referred to as a seal inner-side lower edge 125. The seal inner-side lower edge 125 functions as an example of the first edge. The seal inner-side upper edge 124 and the seal inner-side lower edge 125 parallelly extend along the width direction at an interval from each other in the up and down direction.

As shown in FIG. 9(*a*), each toner seal 92 is attached along the width direction so that the notched portion 123 is opposed to the corresponding inner passing port 89 and the seal inner-side upper edge 124 and the seal inner-side lower edge 125 are along the inner-side edge 135. In this state, a generally rectangular edge (provided with the seal inner-side upper edge 124 and the seal inner-side lower edge 125; hereinafter referred to as a first seal portion 126) forming the notched portion 123 in the toner seal 92 is arranged on the projection 122 along the inner-side edge 135 (see FIG. 9(*b*)). More specifically, the remaining portion (separated from the notched portion 123 and the inner passing port 89 beyond the first seal portion 126; hereinafter referred to as a second seal portion 127) of each toner seal 92 other than the first seal portion 126 is attached along the outer peripheral surface of the inner peripheral wall 83. On the other hand, the first seal portion 126 is arranged on the projection 122, to project radially outward (rearward in FIGS. 9(*a*) and 9(*b*)) of the second seal portion 127 (see FIG. 9(*b*)).

In an edge (separated from the notched portion 123 beyond the seal inner-side upper edge 124 and the seal inner-side lower edge 125) forming the outer periphery of the first seal portion 126, an upper portion is referred to as a seal outer-side upper edge 130, and a lower portion is referred to as a seal outer-side lower edge 131. The seal outer-side upper edge 130 functions as an example of the first edge. The seal outer-side upper edge 130 extends in parallel with the seal inner-side upper edge 124 above the seal inner-side upper edge 124. The seal outer-side lower edge 131 extends in parallel with the seal inner-side lower edge 125 under the seal inner-side lower edge 125.

In the first seal portion 126, a portion located above the inner passing port 89 is referred to as a seal upper portion 138, and a portion located under the inner passing port 89 is referred to as a seal lower portion 139. The seal upper portion 138 and the seal lower portion 139 parallelly extend along the width direction with the inner passing port 89 sandwiched therebetween. In the seal upper portion 138, the upper edge serves as the seal outer-side upper edge 130, and the lower edge serves as the seal inner-side upper edge 124. In the seal lower portion 139, the upper edge serves as the seal inner-side lower edge 125, and the lower edge serves as the seal outer-side lower edge 131.

As shown in FIG. 2(*a*), the inner casing 81 is provided therein with the agitator 93. The agitator 93 includes an agitator shaft 94 extending in the width direction and an agitating vane 95 radially extending outward from the agitator shaft 94. The agitator shaft 94 is rotatably supported by both the inner side walls 84, to rotate by driving force from a motor (not shown) in image formation.

(2-2) Outer Casing

The outer casing 82 is formed slightly larger than the inner casing 81 in the width direction and the radial direction, in order to rotatably receive the inner casing 81. The outer casing 82 integrally includes a generally cylindrical outer peripheral wall 101 extending in the width direction and a pair of generally discoidal outer side walls 102 closing both width-directional end portions of the outer peripheral wall 101, as shown in FIG. 12(*a*).

While the outer peripheral surface of the outer peripheral wall 101 planarly formed on the upper side and the front upper side thereof, the inner peripheral surface of the outer peripheral wall 101 has a circular section.

The outer side walls 102 are respectively provided with circular boss holes 103 receiving the boss portions 85. The outer side walls 102 are further provided with slide holes 104 located above the boss holes 103 for receiving the sliding projections 86 respectively. The slide holes 104 are respectively opposed to the sliding projections 86 in the width direction. The slide holes 104 are respectively in the form of arcs longer than the sliding projections 86 in side view.

Upper fixed portions 105 projecting rearward are respectively provided on rear upper portions of the peripheral end surfaces of the outer side walls 102. Bosses 106 outwardly projecting in the width direction are respectively provided on the rear ends of the upper fixed portions 105.

The outer peripheral wall 101 is provided with four slits 108 receiving the pairs of (four) sandwiching projections 87 respectively on both width-directional end portions. Each slit 108 is opposed to each sandwiching projection 87 in the radial direction. The slit 108 is generally in the form of a rectangle extending in the up and down direction in rear elevational view, with a length corresponding to the swinging range of the shutter 68 between the opening position and the closing position.

The outer peripheral wall 101 is provided with outer passing ports 109 partially forming the cartridge-side passing ports 47 between the four slits 108 (between two upper slits 108 and two lower slits 108). The outer passing ports 109 function as an example of second openings.

More specifically, three outer passing ports 109 are provided at intervals in the width direction correspondingly to the three inner passing ports 89 and the three frame-side passing ports 34 (see FIG. 6). In image formation, each outer passing port 109 is opposed to both of the inner passing port 89 and the frame-side passing port 34 located on the corresponding positions in the width direction.

Each outer passing port 109 is generally in the form of a hexagon larger than the corresponding inner passing port 89 (more specifically, the outer periphery of the first seal portion 126 of the corresponding toner seal 92) in rear elevational view. In the edge of the outer peripheral wall 101 forming each outer passing port 109, an upper portion is referred to as an outer-side upper edge 128, and a lower portion is referred to as an outer-side lower edge 129. The outer-side upper edge 128 and the outer-side lower edge 129 function as examples of an edge of the other frame and a second edge. The outer-side upper edge 128 has a generally inverted V shape intersecting with a line extending along the width direction in rear elevational view (as viewed from the outer side in the radial direction), and the outer-side lower edge 129 has a generally V shape intersecting with the line extending along the width direction in rear elevational view. More specifically, the outer-side upper edge 128 is inclined to be recessed generally in a V-shaped manner from the upstream side toward the downstream side in the direction of movement of the inner casing 81 and the toner seal 92 from an open position to a closed position described later. The outer-side lower edge 129 is inclined to be recessed generally in a V-shaped manner from the upstream side toward the downstream side in the direction of movement of the inner casing 81 and the toner seal 92 from the closed position to the open position described later.

An edge of the outer peripheral wall 101 forming each outer passing port 109 and the inner peripheral surface of the outer peripheral wall 101 are connected with each other through an inclined surface 132 (see FIG. 12(*b*)). The periphery of the edge of the outer peripheral wall 101 forming each outer passing port 109 is chamfered.

A grasp portion 113 is provided on the front side of the outer peripheral wall 101 at the width-directional center.

As shown in FIG. 2(*a*), the grasp portion 113 includes a generally rectangular upper grasp plate 114 projecting frontward from the upper side of the outer peripheral wall 101, and an engaging arm 115 generally J-shaped in side elevational view extending downward under the upper grasp plate 114. The upper end portion of the engaging arm 115 is swingably supported on a support shaft 116 provided under the upper grasp plate 114. An engaging hook 117 engaging with the lower fixing portion 67 is provided on the lower end portion of the engaging arm 115. A generally rectangular lower grasp plate 118 projecting frontward is integrally provided in the vicinity of the upper end portion of the engaging arm 115. The lower grasp plate 118 is so arranged as to extend in parallel with the upper grasp 114 at an interval.

A compression spring (not shown) is interposed between the upper grasp plate 114 and the lower grasp plate 118, to urge the plates 114 and 118 in directions separated from each other.

(2-3) Relative Arrangement of Inner Casing and Outer Casing

The inner casing 81 is pivotably received in the outer casing 82.

More specifically, the outer peripheral surface of the inner peripheral wall 83 is circumferentially slidably engaged with the inner peripheral surface of the outer peripheral wall 101. In other words, each toner seal 92 provided on the outer peripheral surface of the inner peripheral wall 83 is in contact with the inner peripheral surface of the outer peripheral wall 101, and mainly slides with respect to the inner peripheral surface of the outer peripheral wall 101.

As shown in FIG. 10(*a*), each boss hole 103 pivotably supports the corresponding boss portion 85. Each sliding projection 86 is inserted through the corresponding slide hole 104. Each sandwiching projection 87 is inserted through the corresponding slit 108, and the sandwiching projection 87 in turn projects radially outward from the slit 108.

The inner casing 81 is allowed to relatively pivot with respect to the outer casing 82 about the boss portions 85 between the closed position (see FIGS. 12(*a*) and 12(*b*)) where the inner passing ports 89 are not opposed to the outer passing ports 109 and the open position (see FIGS. 2(*a*), 2(*b*), 10(*a*) and 10(*b*)) where the inner passing ports 89 are opposed to the outer passing ports 109.

The toner stored in the inner casing 81 passes through the inner passing ports 89 and the outer passing ports 109 opposed to each other along a generally horizontal direction (i.e., the radial direction) as described later (see FIG. 2(*a*)). On the other hand, the inner casing 81 pivots with respect to the outer casing 82 along the circumferential direction. In other words, the inner casing 81 and the outer casing 82 relatively move with respect to each other in the circumferential direction, which is orthogonal to the direction (radial direction) of passage of the toner through the inner passing ports 89.

(2-3-1) Movement of Inner Casing from Closed Position to Open Position

When the inner casing 81 is on the closed position, the respective sliding projections 86 are arranged on the front end portions of the slide holes 104, the respective sandwiching projections 87 are arranged on the upper end portions of the slits 108, the respective inner passing ports 89 are arranged upward of the outer passing ports 109, and the outer passing ports 109 are closed with the lower portion of the surrounded portion 88, as shown in FIG. 12(*a*). In other words, the inner passing ports 89 are closed with the outer casing 82.

When the inner casing 81 is not received in and is separated from the outer casing 82, the first seal portion 126 arranged on the projection 122 in each toner seal 92 projects radially outward of the second seal portion 127, as hereinabove described (see FIGS. 9(*a*) and 9(*b*)). When the inner casing 81 is received in the outer casing 82 and arranged on the closed position, therefore, the first seal portion 126 is pressed against the outer peripheral wall 101 by the projection 122, to be more compressed between the outer peripheral wall 101 and the inner peripheral wall 83 than the second seal portion 127 (see FIG. 12(*b*)). In other words, the contact pressure of the first seal portion 126 to the inner peripheral surface of the outer peripheral wall 101 is higher than the contact pressure of the second seal portion 127 to the inner peripheral surface of the outer peripheral wall 101 in this state.

The seal outer-peripheral lower edge 134 is exposed in the outer passing port 109 in contact with neither the outer-side upper edge 128 nor the outer-side lower edge 129.

The inner casing 81 is relatively pivoted with respect to the outer casing 82 about the boss portions 85, to direct the inner passing port 89 toward the outer passing port 109 (downward). Thus, each sliding projection 86 slides in each slide hole 104 from the front end portion toward the rear end portion, and each sandwiching projection 87 slides in each slit 108 from the upper end portion toward the lower end portion, as shown in FIG. 11(*a*). After a while, in the first seal portion 126, the seal lower portion 139 lowers while being in contact with the outer-side upper edge 128, and starts to be exposed from the outer passing port 109. Thus, the seal lower portion 139 is released from the compression between the outer peripheral wall 101 and the inner peripheral wall 83. The rear end portion (radial outer-side end portion) of the seal lower portion 139 is guided along the inclined surface 132 from the lower passing port 109, to start projecting radially outward from the outer peripheral wall 101 (see FIG. 11(*b*)). At this time, the seal outer-side lower edge 131 and the seal inner-side lower edge 125 of the seal lower portion 139 successively come into contact with the outer-side upper edge 128, to escape from the outer-side upper edge 128.

When the inner casing 81 is further pivoted, the seal outer-side lower edge 131 and the seal inner-side lower edge 125 successively separate from the outer-side upper edge 128, to be successively out of contact with the outer-side upper edge 128. Thus, the seal lower portion 139 is completely exposed in the outer passing port 109, to project radially outward from the outer peripheral wall 101.

On the other hand, the seal outer-peripheral lower edge 134 starts coming into contact with the outer-side lower edge 129 to be opposed to the outer-side lower edge 129 in the pivoting direction of the inner casing 81, though not shown. At this time, the seal outer-peripheral lower edge 134 extends along the width direction while the outer-side lower edge 129 has the generally V shape intersecting with the line extending along the width direction in rear elevational view (as viewed from the outer-side in the radial direction), as hereinabove described. Therefore, the seal outer-peripheral lower edge 134 and the outer-side lower edge 129 coming into contact with each other intersect with each other in rear elevational view. Further, the seal outer-peripheral lower edge 134 and the outer-side lower edge 129 are in contact (in point contact) with each other on two positions separated from each other to be symmetrical in the width direction, and these contact positions approach each other in the width direction as the inner passing port 89 lowers toward the outer passing port 109.

In the first seal portion 126, the seal upper portion 138 lowers while being in contact with the outer-side upper edge 128 and starts to be exposed from the outer passing port 109, though not shown. Thus, in the first seal portion 126, not only the seal lower portion 139 but also the seal upper portion 138 is released from the compression between the outer peripheral wall 101 and the inner peripheral wall 83, and the rear end portion of the seal upper portion 138 is guided along the inclined surface 132 from the outer passing port 109, to start projecting radially outward from the outer peripheral wall 101. At this time, the seal inner-side upper edge 124 and the seal outer-side upper edge 130 of the seal upper portion 138 successively come into contact with the outer-side upper edge 128, to escape from the outer-side upper edge 128.

When the inner casing 81 is further pivoted, the seal inner-side upper edge 124 and the seal outer-side upper edge 130 successively separate from the outer-side upper edge 128 to be successively out of contact with the outer-side upper edge 128, as shown in FIG. 10(*a*). Thus, the seal upper portion 138 is completely exposed in the outer passing port 109, to project radially outward from the outer peripheral wall 101.

The seal outer-peripheral lower edge 134 separates from the outer-side lower edge 129 and enters into the radial inner side of the outer peripheral wall 101 (see FIG. 10(*b*)), to be out of contact with the outer-side lower edge 129.

Each sliding projection 86 comes into contact with the rear end edge of each slide hole 104 and each sandwiching projection 87 comes into contact with the lower end edge of each slit 108, whereby the inner casing 81 is arranged on the open position.

When the inner casing 81 is arranged on the open position, each sliding projection 86 is arranged on the rear end portion of each slide hole 104, each sandwiching projection 87 is arranged on the lower end portion of each slit 108, and each inner passing port 89 is opposed to the corresponding outer passing port 109, communicated with each other and opened. In other words, the inner passing port 89 is opened by the outer casing 82.

When the inner casing 81 is arranged on the open position, further, the first seal portion 126 of each toner seal 92 is entirely exposed from the corresponding outer passing port 109, to project radially outward of the outer peripheral wall 101 (see FIG. 10(*b*)). In this state, the first seal portion 126 is arranged separately from the outer-side upper edge 128 and the outer-side lower edge 129 in the outer passing port 109 as viewed from the outer side in the radial direction. In other words, the seal inner-side upper edge 124, the seal inner-side lower edge 125, the seal outer-side upper edge 130 and the seal outer-side lower edge 131 are also arranged separately from the outer-side upper edge 128 and the outer-side lower edge 129 in the outer passing port 109. The second seal portion 127 of each toner seal 92 is compressed between the outer peripheral wall 101 and the inner peripheral wall 83, to surround the corresponding inner passing port 89 and the corresponding outer passing port 109 (see FIG. 10(*b*)). Thus, leakage of the toner from the inner and outer passing ports 89 and 109 communicating with each other to the space between the outer peripheral wall 101 and the inner peripheral wall 83 is prevented.

(2-3-2) Movement of Inner Casing from Open Position to Closed Position

The inner casing 81 located on the open position is relatively pivoted with respect to the outer casing 82 about the boss portions 85 in the direction (upward) for separating the inner passing ports 89 from the outer passing ports 109. As shown in FIG. 11(*a*), the seal upper portion 138 rises in contact with the outer-side upper edge 128 in each first seal portion 126, and is guided along the inclined surface 132 to enter into the radial inner side of the outer peripheral wall 101 (see FIG. 11(*b*)). Thus, the seal upper portion 138 starts to be compressed between the outer peripheral wall 101 and the inner peripheral wall 83. Each sliding projection 86 slides in each slide hole 104 from the rear end portion toward the front end portion, and each sandwiching projection 87 slides in each slit 108 from the lower end portion toward the upper end portion.

At this time, the seal outer-side upper edge 130 of the seal upper portion 138 comes into contact with the outer-side upper edge 128 to be opposed to the outer-side upper edge 128 in the pivot direction of the inner casing 81, though not shown. The seal outer-side upper edge 130 extends along the width direction, while the outer-side upper edge 128 has the generally inverted V shape intersecting with the line extending along the width direction in rear elevational view (as viewed from the outer side in the radial direction), as hereinabove described. Therefore, the seal outer-side upper edge 130 and the outer-side upper edge 128 come into contact with each other in a state of intersecting with each other in rear elevational view. More specifically, the seal outer-side upper edge 130 and the outer-side upper edge 128 come into point contact with each other on two positions separated from each other to be symmetrical in the width direction. These contact portions approach each other in the width direction as the inner passing port 89 separates from the outer passing port 109 and rises. The seal inner-side upper edge 124 comes into contact with the outer-side upper edge 128 to escape from the outer-side upper edge 128, subsequently to the seal outer-side upper edge 130.

When the inner casing 81 is further pivoted, the seal outer-side upper edge 130 and the seal inner-side upper edge 124 successively separate from the outer-side upper edge 128, to be successively out of contact with the outer-side upper edge 128. Then, the seal upper portion 138 completely enters into the radial inner side of the outer peripheral wall 101, to be compressed between the outer peripheral wall 101 and the inner peripheral wall 83 (see FIG. 11(*b*)).

The seal outer-peripheral lower edge 134 is exposed in the outer passing port 109 in contact with neither the outer-side upper edge 128 nor the outer-side lower edge 129.

When the inner casing 81 is further pivoted, the seal lower portion 139 of the first seal portion 126 rises while being in contact with the outer-side upper edge 128, and is guided along the inclined surface 132, to enter into the radial inner side of the outer peripheral wall 101. Thus, the seal lower portion 139 starts to be compressed between the outer peripheral wall 101 and the inner peripheral wall 83.

At this time, the seal inner-side lower edge 125 of the seal lower portion 139 comes into contact with the outer-side upper edge 128 to be opposed to the outer-side upper edge 128 in the pivot direction of the inner casing 81. The seal inner-side lower edge 125 extends along the width direction, while the outer-side upper edge 128 has the generally inverted V shape intersecting with the line extending along the width direction in rear elevational view (as viewed from the outer side in the radial direction), as hereinabove described. Therefore, the seal inner-side lower edge 125 and the outer-side upper edge 128 come into contact with each other in a state of intersecting with each other in rear elevational view. More specifically, the seal inner-side lower edge 125 and the outer-side upper edge 128 come into point contact with each other on two positions separated from each other to be symmetrical in the width direction. These contact portions approach each other in the width direction as the inner passing port 89 separates from the outer passing port 109 and rises. The seal outer-side lower edge 131 comes into contact with the outer-side upper edge 128 to escape from the outer-side upper edge 128, subsequently to the seal inner-side lower edge 125.

When the inner casing 81 is further pivoted, the seal inner-side lower edge 125 and the seal outer-side lower edge 131 successively separate from the outer-side upper edge 128, to be successively out of contact with the outer-side upper edge 128. The seal lower portion 139 completely enters into the radial inner side of the outer peripheral wall 101, to be compressed between the outer peripheral wall 101 and the inner peripheral wall 83 (see FIG. 12(*b*)).

Thereafter each sliding projection 86 comes into contact with the front end edge of each slide hole 104 and each sandwiching projection 87 comes into contact with the upper end edge of each slit 108, whereby the inner casing 81 is arranged on the closed position, as shown in FIG. 12(*a*). At this time, the first seal portion 126 completely enters in the radial inner side of the outer peripheral wall 101, and is compressed between the outer peripheral wall 101 and the inner peripheral wall 83 along with the second seal portion 127 (see FIG. 12(*b*)).

(3) Attachment/Detachment of Toner Cartridge to/from Process Frame (3-1) Attachment of Toner Cartridge to Process Frame In order to attach the toner cartridge 31 to the process frame 22, the upper grasp plate 114 and the lower grasp plate 118 are grasped in a direction toward which they approach each other against the urging force of the compression spring (not shown), as shown in FIG. 5. Then, the toner cartridge 31 (having the inner casing 81 arranged on the closed position) is attached to the cartridge receiving area 33 (having the shutter 68 arranged on the closing position and the swinging arm 70 arranged on the pressing cancellation position).

Thus, the toner cartridge 31 is placed on the bottom plate 64. At this time, each boss 106 is placed on each upper fixing portion 66, each sliding projection 86 engages with each receiving recess 75 as shown in FIG. 4, and the pairs of sandwiching projections 87 provided on both width-directional sides sandwich the upper and lower end edges of both width-directional end portions of the shutter 68 respectively, as shown in FIG. 2(*a*).

Thereafter grasping of the upper grasp plate 114 and the lower grasp plate 118 are released, whereby the engaging arm 115 swings due to the urging force of the compression spring, the engaging hook 117 engages with the lower fixing portion 67, and the toner cartridge 31 is received in the cartridge receiving area 33.

The outer casing 82 is fixed to the cartridge receiving area 33 since each boss 106 is placed on the corresponding upper fixing portion 66 and the engages hook 117 engaging with the lower fixing portion 67.

Then, the swinging arm 70 swings from the pressing cancellation position to the pressing position. Thus, each sliding projection 86 engaging with each receiving recess 75 slides in each slide hole 104 rearward following swinging of each arm side plate 72, to be arranged on the rear end portion of each slide hole 104 (see FIG. 4). Following this, the pairs of sandwiching projections 87 provided on both width-directional sides slide in the slits 108 downward while sandwiching the shutter 68, to be arranged on the lower end portions of the slits 108 (see FIG. 10(*a*)).

Thus, the inner casing 81 is arranged on the open position, and each inner passing port 89 is generally horizontally opposed to the corresponding outer passing port 109, so that the inner and outer passing ports 89 and 109 communicate with each other, as shown in FIG. 2(*a*). Further, the shutter 68 is arranged on the opening position, and each frame-side passing port 34 is generally horizontally opposed to the corresponding shutter opening 69 and the corresponding cartridge-side passing port 47 (the inner passing port 89 and the outer passing port 109), so that the frame-side passing port 34 communicates with the shutter opening 69 and the cartridge-side passing port 47. In addition, as described above, each first seal portion 126 (see FIG. 2(*b*)) projecting radially outward from the outer peripheral wall 101 when the inner casing 81 is on the open position, is pressed against the shutter 68 to surround the corresponding shutter opening 69, and blocks the clearance between the inner passing port 89 and the shutter opening 69.

In image formation, the toner stored in the inner casing 81 is agitated by the agitator 93 to pass through the inner passing port 89, the outer passing port 109, the shutter opening 69 and the frame-side passing port 34 generally along the horizontal direction, and fed to the developing area 32.

(3-2) Detachment of Toner Cartridge from Process Frame

In order to detach the toner cartridge 31 from the process frame 22, the swinging arm 70 first swings from the pressing position to the pressing cancellation position.

When the swinging arm 70 swings from the pressing position to the pressing cancellation position, each sliding projection 86 (see FIG. 4) engaging with each receiving recess 75 slides in each slide hole 104 frontward following swinging of each arm side plate 72, to be arranged on the front end portion of each slide hole 104, as shown in FIG. 12(*a*). Then, the pairs of sandwiching projections 87 on both the width-directional sides slide in the slits 108 upward while sandwiching the shutter 68, to be arranged on the upper end portions of the slits 108.

Thus, the inner casing 81 is arranged on the closed position, and the lower portion of the surrounded portion 88 is opposed to the outer passing ports 109, to close the outer passing ports 109. Further, the shutter 68 is arranged on the closing position, so that the frame-side passing ports 34 are opposed to and closed with the shutter 68 (see FIG. 3).

The upper grasp plate 114 and the lower grasp plate 118 shown in FIG. 2(*a*) are grasped in the direction toward which they approach each other, whereby the engaging hook 117 disengages from the lower fixing portion 67. When the toner cartridge 31 is drawn out from the cartridge receiving area 33 frontward in this state as shown in FIG. 5, therefore, the toner cartridge 31 is detached from the process frame 22.

3. Functions and Effects of Embodiment (1)

In this toner cartridge 31, as shown in FIG. 12(*b*), each toner seal 92 provided on the inner casing 81 comes into sliding contact with the outer casing 82 (more specifically, the outer peripheral wall 101), when the outer casing 82 relatively moves with respect to the inner casing 81 in order to open/close each inner passing port 89. Therefore, leakage of the toner from the inner passing ports 89 to the space between the inner casing 81 and the outer casing 82 can be prevented not only in a stationary state but also in the operation of opening/closing the inner passing ports 89.

As shown in FIG. 11(*a*), the first edge (the seal inner-side lower edge 125, the seal outer-side upper edge 130 and the seal outer-peripheral lower edge 134) of each toner seal 92 and the second edge (the outer-side upper edge 128 and the outer-side lower edge 129) coming into contact with each other when the outer casing 82 opens/closes each inner passing port 89, intersect with each other in rear elevational view (as viewed from the outer side in the radial direction).

If the first edge and the second edge are parallel to each other in rear elevational view, entirely come into contact (line contact) with each other in the extensional direction thereof at the same time when the outer casing 82 opens/closes each inner passing port 89. Thus, the first edge is easily caught by the second edge, and hence the toner seal 92 having the first edge is easily separated when the inner passing port 89 is opened/closed.

According to this embodiment, however, the first edge and the second edge intersect with each other in rear elevational view, whereby the first and second edges can successively partially come into contact (point contact) with each other in the extensional direction thereof when the outer casing 82 opens/closes each inner passing port 89. Consequently, the first edge is hardly caught by the second edge, whereby the toner seal 92 can be prevented from being separated when the inner passing port 89 is opened/closed.

Further, each toner seal 92 is provided on the inner casing 81 having the inner passing ports 89. If the toner seal 92 is provided on the outer casing 82, the toner seal 92 shifts from the corresponding inner passing port 89 upon movement of the inner casing 81, and hence an additional seal is required in order to prevent leakage of the toner from the inner passing port 89. According to this embodiment, however, the toner seal 92 is provided on the inner casing 81, whereby no such additional seal is required.

The first edge and the second edge coming into contact with each other when the outer casing 82 opens/closes the inner passing port 89, intersect with each other in rear elevational view, whereby these edges can successively partially come into contact with each other in the extensional direction thereof when the outer casing 82 opens/closes the inner passing port 89. Thus, the first edge is hardly caught by the second edge, whereby the toner seal 92 can be prevented from being separated when the inner passing port 89 is opened/closed.

As hereinabove described, the second edge is inclined from the upstream side toward the downstream side in the direction of relative movement of the first edge (i.e., the toner seal 92) when the outer casing 82 opens/closes the inner passing port 89. Thus, the contact timing between the first edge and the second edge can be delayed at a ratio corresponding to the angle of inclination of the second edge, whereby separation of the toner seal 92 can be further prevented when the inner passing port 89 is opened/closed.

The second edge is inclined to be recessed in the V-shape from the upstream side toward the downstream side in the direction of relative movement of the first edge when the outer casing 82 opens/closes the inner passing port 89, whereby the first edge can come into contact with the second edge of the V-shape on a symmetrical position in a well-balanced manner. Thus, the first edge is hardly caught by the second edge, whereby separation of the toner seal 92 can be further prevented when the inner passing port 89 is opened/closed. Furthermore, the symmetrically positioned two contact points between the first edge and the second edge approach each other when the outer casing 82 opens/closes the inner passing port 89. More specifically, the two contact points between the seal outer-peripheral lower edge 134 and the outer-side lower edge 129 approach each other when the outer casing 82 opens the inner passing port 89, and the two contact points between each of the seal inner-side lower edge 125 and the seal outer-side upper edge 130 and the outer-side upper edge 128 approach each other when the outer casing 82 closes the inner passing port 89. The contact between the first edge and the second edge is successively released from both end portions toward the center in the direction (width direction) of arrangement of these contact points, whereby separation of the toner seal 92 can be further prevented when the inner passing port 89 is opened/closed, as compared with the contrary case (where these contact points are spaced away from each other).

As shown in FIGS. 9(*a*) and 9(*b*), the seal inner-side upper edge 124 and the seal inner-side lower edge 125 are provided along the edge (the inner-side edge 135) of the inner passing port 89, whereby the toner seal 92 can reliably prevent leakage of the toner from the inner passing port 89 on the inner-side edge 135.

As shown in FIGS. 10(*a*) and 10(*b*), the seal inner-side upper edge 124, the seal inner-side lower edge 125, the seal outer-side upper edge 130 and the seal outer-side lower edge 134 of the first edge are separated from the second edge in the outer passing port 109 in rear elevational view when the inner passing port 89 and the outer passing port 109 are opposed to each other, i.e., when the inner passing port 89 is opened. If the first edge separates from the second edge, an impact upon contact between the first edge and the second edge is increased, and hence the first edge is easily caught by the second edge when the inner passing port 89 is closed. Also in this case, however, the first edge and the second edge intersect with each other in rear elevational view to partially come into contact with each other, so that the first edge is hardly caught by the second edge, whereby separation of the toner seal 92 can be prevented when the inner passing port 89 is opened/closed.

As shown in FIG. 12(*b*), the projection 122 provided on the peripheral edge (the inner-side edge 135) of the inner passing port 89 in the inner casing 81, presses the corresponding first seal portion 126 against the outer casing 82. Therefore, the contact pressure of the first seal portion 126 to the outer casing 82 can be made higher than the contact pressure of the second seal portion 127 to the outer casing 82 with a simple structure. Thus, leakage of the toner from the inner passing port 89 can be reliably prevented on the peripheral edge of the inner passing port 89 with the first sealing portion 126 having the relatively high contact pressure to the outer casing 82. The contact pressure of the second seal portion 127 to the outer casing 82 is lower than the contact pressure of the first seal portion 126 to the outer casing 82. Thus, sliding resistance between the outer casing 82 and the toner seal 92 can be reduced in the operation of opening/closing the inner passing port 89, as compared with a case where the contact pressure of the second seal portion 127 is equal to the contact pressure of the first seal portion 126. Therefore, reduction of the operability for opening/closing the inner passing port 89 can be suppressed while preventing leakage of the toner from the inner passing port 89.

When the outer casing 82 opens the inner passing port 89, the first seal portion 126 is positioned on the outer side of the outer casing 82 in the projecting direction (radial direction) of the projection 122, as shown in FIG. 2(*b*). When the toner is fed from the inner casing 81 to an apparatus other than the toner cartridge 31, therefore, leakage of the toner can be prevented between the inner passing port 89 and the apparatus by bringing the first seal portion 126 into contact with this apparatus. More specifically, the first seal portion 126 is brought into contact with the process frame 22 (more specifically, the shutter 68) as shown in FIG. 2(*a*), in order to feed the toner from the inner casing 81 to the process frame 2 by opposing the inner passing port 89 to the corresponding frame-side passing port 34 of the process frame 22. Thus, leakage of the toner can be prevented between the inner passing port 89 and the frame-side passing port 34 and between the inner passing port 89 and the shutter opening 69.

When the outer casing 82 opens the inner passing port 89, the first seal portion 126 is positioned on the outer side of the outer casing 82 in the outer passing port 109, as shown in FIGS. 10(*a*) and 10(*b*). Therefore, when the inner passing port 89 is closed, the first edge (the seal inner-side lower edge 125 and the seal outer-side upper edge 130) of the first seal portion 126 is easily caught by the second edge (the outer-side upper edge 128) of the outer casing 82, and the first seal portion 126 is easily separated. Also in this case, however, the first edge and the second edge intersect with each other in rear elevational view to successively partially come into contact with each other, so that the first edge is hardly caught by the second edge, whereby the toner seal 92 can be prevented from separation when the inner passing port 89 is closed.

The toner seal 92 includes not only the first seal portion 126 but also the second seal portion 127, whereby separation of the toner seal 92 can be further prevented when the inner passing port 89 is opened/closed, as compared with a case where the toner seal 92 includes only the first seal portion 126.

(2)

In this toner cartridge 31, the toner seal 92 provided on the inner casing 81 comes into sliding contact with the outer casing 82 (more specifically, the outer peripheral wall 101) when the outer casing 82 opens/closes the inner passing port 89, as shown in FIG. 12(*b*). Therefore, leakage of the toner from the inner passing port 89 to the space between the inner casing 81 and the outer casing 82 can be prevented not only in the stationary state but also in the operation of opening/closing the inner passing port 89.

In the toner seal 92, the contact pressure of the first seal portion 126 to the outer casing 82 (more specifically, the outer peripheral wall 101) is higher than the contact pressure of the second seal portion 127 to the outer casing 82. Thus, leakage of the toner from the inner passing port 89 can be reliably prevented on the inner-side edge 135 with the first seal portion 126 having the relatively high contact pressure to the outer casing 82. The contact pressure of the second seal portion 127 to the outer casing 82 is lower than the contact pressure of the first seal portion 126 to the outer casing 82. Thus, sliding resistance between the outer casing 82 and the toner seal 92 can be reduced in the operation of opening/closing the inner passing port 89, as compared with the case where the contact pressure of the second seal portion 127 is equal to the contact pressure of the first seal portion 126.

Further, the toner seal 92 includes not only the first seal portion 126 but also the second seal portion 127, whereby separation of the toner seal 92 can be further prevented when the inner passing port 89 is opened/closed, as compared with the case where the toner seal 92 includes only the first seal portion 126.

Consequently, reduction of the operability for opening/closing the inner passing port 89 can be suppressed while preventing leakage of the toner from the inner passing port 89.

Further, the projection 122 presses the first seal portion 126 against the outer casing 82. Therefore, the contact pressure of the first seal portion 126 to the outer casing 82 can be made higher than the contact pressure of the second seal portion 127 to the outer casing 82 with the simple structure.

In addition, the projection 122 is provided on the inner-side edge 135 in the inner casing 81. Therefore, the projection 122 presses the first seal portion 126 against the outer casing 82, whereby the contact pressure of the first seal portion 126 to the outer casing 82 can be made higher than the contact pressure of the second seal portion 127 to the outer casing 82.

When the outer casing 82 opens the inner passing port 89, the first seal portion 126 is positioned on the outer side of the outer casing 82 in the projecting direction (radial direction) of the projection 122, as shown in FIG. 2(*b*). When the toner stored in the inner casing 81 is fed to the apparatus other than the toner cartridge 31, therefore, leakage of the toner can be prevented between the inner passing port 89 and the apparatus by bringing the first seal portion 126 into contact with this apparatus. More specifically, the first seal portion 126 is brought into contact with the process frame 22 (more specifically, the shutter 68) as shown in FIG. 2(*a*), in order to feed the toner stored in the inner casing 81 to the process frame 22 by opposing the inner passing port 89 to the corresponding frame-side passing port 34 of the process frame 22. Thus, leakage of the toner can be prevented between the inner passing port 89 and the frame-side passing port 34 and between the inner passing port 89 and the shutter opening 69.

The outer casing 82 receives the inner casing 81, so that the toner cartridge 31 has a double structure. The outer passing port 109 provided on the outer casing 82 for opening the inner passing port 89 when opposed to the inner passing port 89, is larger than the inner passing port 89 as shown in FIGS. 10(*a*) and 10(*b*), whereby the first seal portion 126 can be reliably arranged on the outer side of the outer casing 82 when the outer casing 82 opens the inner passing port 89.

The projection 122 is provided along the entire periphery of the inner-side edge 135 as shown in FIGS. 7(*a*) and 7(*b*), whereby the contact pressure of the first seal 126 to the outer casing 82 can be made higher than the contact pressure of the second seal portion 127 to the outer casing 82 along the entire periphery of the inner-side edge 135, as shown in FIG. 12(*b*). Thus, leakage of the toner from the inner passing port 89 can be reliably prevented along the entire periphery of the inner-side edge 135. If the first seal portion 126 can be brought into contact with the outer casing 82 along the entire periphery of the inner-side edge 135, the projection 122 may alternatively be partially provided on the inner-side edge 135.

The toner seal 92 is provided on the inner casing 81 having the inner passing port 89. If the toner seal 92 is provided on the outer casing 82, the toner seal 92 shifts from the inner passing port 89 when the inner casing 81 moves, and hence an additional seal is required in order to prevent leakage of the toner from the inner passing port 89. According to this embodiment, however, the toner seal 92 is provided on the inner casing 81, whereby no such additional seal may be provided.

The first seal portion 126 is provided on the projection 122, whereby the projection 122 can reliably press the first seal portion 126 against the outer casing 82.

In the state where the toner cartridge 31 is attached in the process frame 22, the first seal portion 126 is in contact with the process frame 22 (more specifically, the shutter 68), as shown in FIG. 2(*a*). Thus, leakage of the toner can be prevented between the inner passing port 89 and the process frame 22, and the frame-side passing port 34 and the shutter opening 69 of the process frame 22 can smoothly receive the toner from the inner passing port 89.

Second Embodiment

In the aforementioned embodiment, the process cartridge 17 integrally includes the photosensitive drum 25 and the developing roller 37, and is detachably mounted to the main body casing 2, as shown in FIG. 1. Alternatively, the process cartridge 17 may be formed as a developing cartridge including no photosensitive drum 25, another unit (drum cartridge) including the photosensitive drum 25 may be provided, and the developing cartridge may be detachably mounted to this drum cartridge, for example. Further alternatively, the process cartridge 17 may be kept attached in the main body casing 2, and only the toner cartridge 31 may be detachably mounted to the process cartridge 17.

Further, the main body casing 2 may be provided with the photosensitive drum 25, the scorotron charger 26 and the transfer roller 28, and the developing cartridge may be detachably mounted to the main body casing 2.

Third Embodiment

While the monochromatic laser printer 1 is illustrated in the aforementioned embodiment, the image forming apparatus according to one or more aspects of the present invention can also be formed as a color laser printer (including tandem and intermediate transfer printers), for example.

Fourth Embodiment

The toner may be circulated between the developing area 32 and the toner cartridge 31. In this case, an auger, for example, is provided in the developing area 32. The toner stored in the toner cartridge 31 is fed into the developing area 32 through the cartridge-side passing port 47 (see FIG. 10(*a*)) and the frame-side passing port 34 (see FIG. 6) located at the width-directional center, and this toner is transported by the auger in both width-directional sides, to be fed to the feed roller 36. On the other hand, the toner not successfully fed to the feed roller 36 is returned to the toner cartridge 31 through the frame-side passing ports 34 and the cartridge-side passing ports 47 located on both the width-directional sides.

Fifth Embodiment

Figure 13:
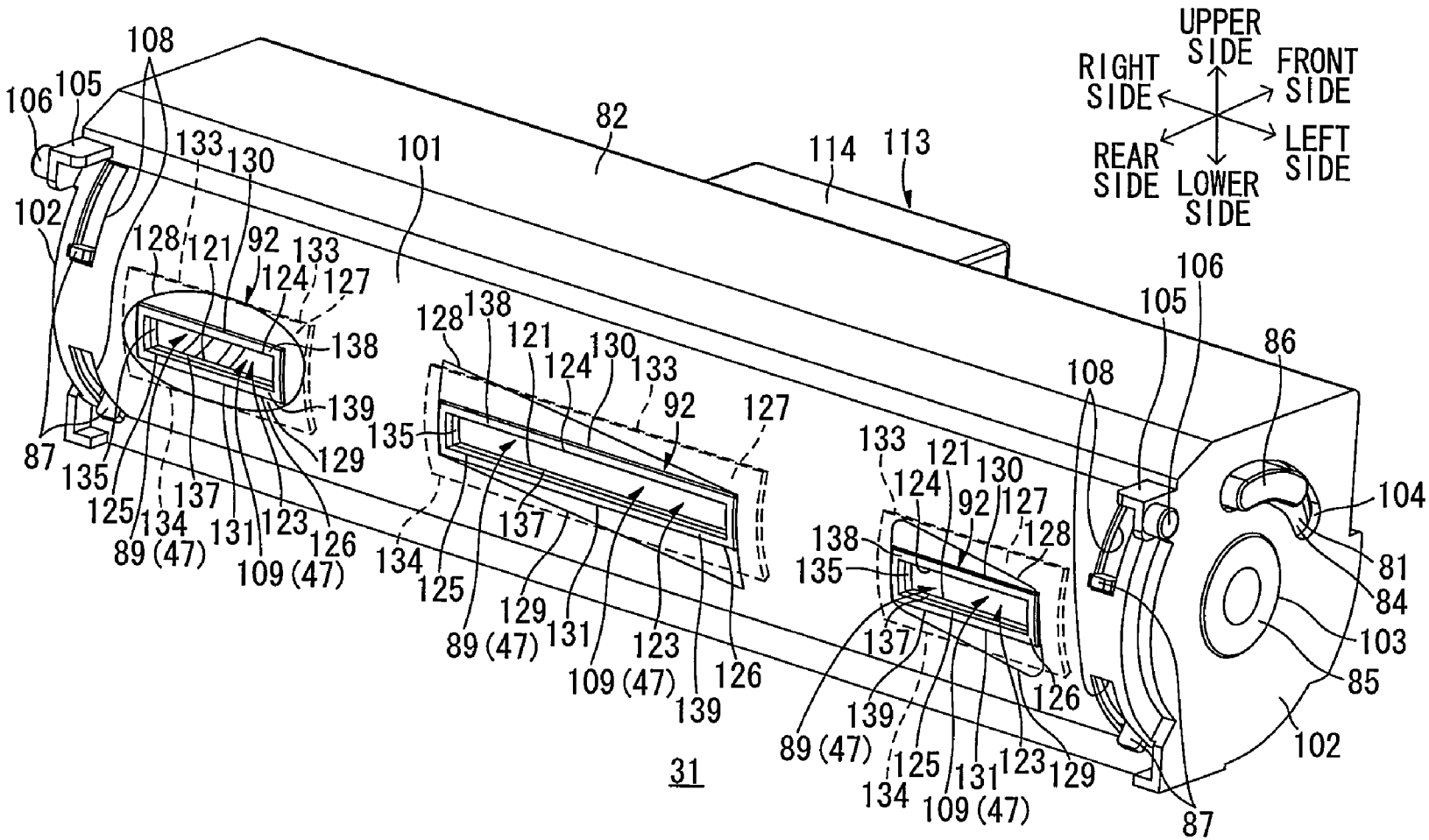
FIG. 13 illustrates a fifth embodiment applied to FIG. 10(*a*).

FIG. 13 illustrates a fifth embodiment applied to FIG. 10(*a*).

In the aforementioned embodiment, each of the outer-side upper edges 128 and the outer-side lower edges 129 has generally the inverted V shape or the V shape intersecting with the line extending along the width direction. Thus, the outer-side upper edges 128 and the outer-side lower edges 129 can be brought into point contact with the respective edges (the seal inner-side lower edges 125, the seal outer-side upper edges 130 and the seal outer-peripheral lower edges 134) extending along the width direction in the toner seals 92, so that theses edges are not caught by the outer-side upper edges 128 and the outer-side lower edges 129. If similar functions and effects can be attained, however, each of the outer-side upper edges 128 and the outer-side lower edges 129 may not have generally the inverted V shape or the V shape.

For example, the outer-side upper edge 128 and the outer-side lower edge 129 may be inclined either leftward or rightward along the circumferential direction of the outer peripheral wall 101, as shown in the outer passing port 109 located at the width-directional center in FIG. 13.

Alternatively, the edge, including the outer-side upper edge 128 and the outer-side lower edge 129, forming the outer passing port 109 in the outer peripheral wall 101 may be formed in a curved shape, as shown in the left outer passing port 109 in FIG. 13. Thus, the edge forming the outer passing port 109 in the outer peripheral wall 101 has no corner, whereby the toner seal 92 can be further prevented from being caught by this edge. Further alternatively, the edge forming the outer passing port 109 in the outer peripheral wall 101 may be generally circularly formed, as shown in the right outer passing port 109 in FIG. 13.

Sixth Embodiment

While the inner casing 81 is pivoted from the closed position to the open position so that each inner passing port 89 lowers toward the corresponding outer passing port 109 in the aforementioned embodiment, the inner casing 81 may alternatively be pivoted from the closed position to the open position so that the inner passing port 89 rises toward the outer passing port 109. Also in this case, the edge of the toner seal 92 is prevented from being caught by the outer-side upper edge 128 and the outer-side lower edge 129, as shown in FIGS. 11(*a*) and 11(*b*).

While the inner casing 81 is pivoted with respect to the outer casing 82 in the aforementioned embodiment, the outer casing 82 may alternatively be pivoted with respect to the inner casing 81. More specifically, the outer casing 82 is pivoted between the open position and the closed position, and each inner passing port 89 is opposed to the corresponding outer passing port 109 and opened when the outer casing 82 is on the open position, and the inner passing port 89 is closed by a portion of the outer peripheral wall 101 other than the corresponding outer passing port 109 when the outer casing 82 is on the closed position.

Further, the toner cartridge 31 may not have the double structure with the outer casing 82 receiving the inner casing 81. In this case, the outer casing 82 may be formed as a shutter arranged on the outer side of the inner casing 81 and slidable with respect to the outer peripheral surface of the inner peripheral wall 83. If the outer casing 82 is formed as a shutter, each inner passing port 89 can be opened by simply shifting the outer casing 82 itself from the inner passing port 89 without opening the inner passing port 89 by opposing the corresponding outer passing port 109 thereto, whereby the outer casing 82 may not be provided with the outer passing port 109.

In order to project each first seal portion 126 radially outward from the outer peripheral wall 101 when the inner passing port 89 is opened, the toner seal 92 may be provided not on the inner casing 81 but on the outer casing 82. In this case, the toner seal 92 is attached to the inner peripheral surface of the outer peripheral wall 101, to expose the first seal portion 126 in the corresponding outer passing port 109. Thus, when the inner passing port 89 is opposed to the outer passing port 109, the first seal portion 126 exposed in the outer passing port 109 is pressed by the projection 122 provided on the edge of the inner passing port 89, to project outward from the outer peripheral wall 101. Also in this case, the inner casing 81 may be pivoted with respect to the outer casing 82, or the outer casing 82 may be pivoted with respect to the inner casing 81, as a matter of course.

Seventh Embodiment

Figure 14:
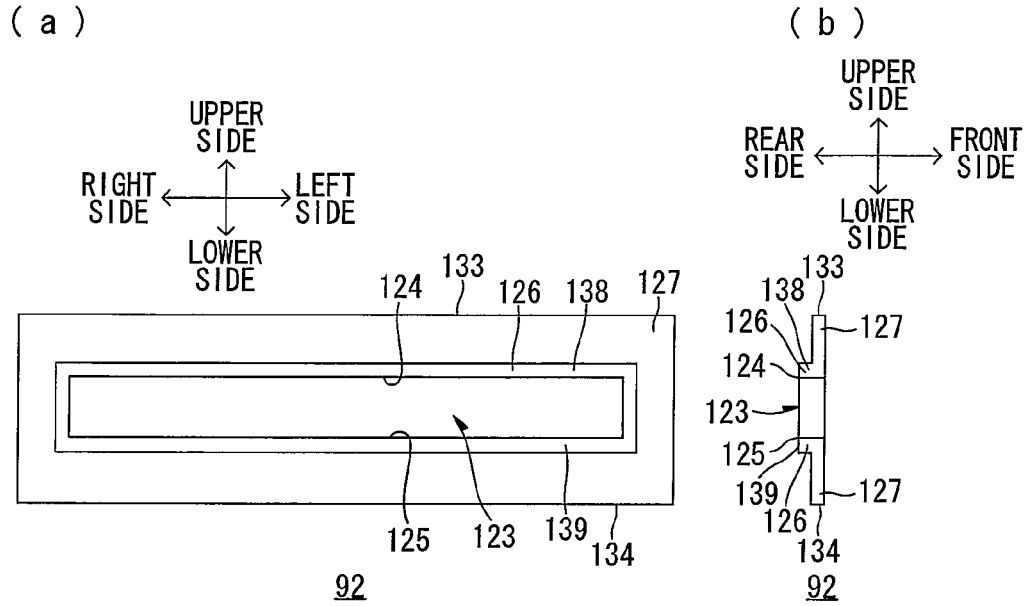
FIG. 14(*a*) is a rear elevational view of a toner seal according to a seventh embodiment.

FIG. 14(*a*) is a rear elevational view of a toner seal according to a seventh embodiment. FIG. 14(*b*) is a side sectional view of the toner seal according to the seventh embodiment.

In the aforementioned embodiment, each first seal portion 126 is projected radially outward beyond each second seal portion 127 when the toner seal 92 is attached to the inner peripheral wall 83 as shown in FIGS. 9(*a*) and 9(*b*), in order to make the contact pressure of the first seal portion 126 to the outer peripheral wall 101 higher than the contact pressure of the second seal portion 127 to the outer peripheral wall 101. More specifically, the projection 122 is provided on the inner-side edge 135 of each inner passing port 89 so as to project the first seal portion 126 radially outward beyond the second seal portion 127 (see FIG. 9(*b*)) when the toner seal 92 (see FIG. 8(*b*)) having the uniform anteroposterior length (thickness) is attached to the inner peripheral wall 83, as hereinabove described.

Alternatively, the toner seal 92 may be so formed that the first seal portion 126 projects radially outward beyond the second seal portion 127 before the toner seal 92 is attached to the inner peripheral wall 83. More specifically, the thickness of the first seal portion 126 is set larger than that of the second seal portion 127 in the toner seal 92, as shown in FIG. 14(*b*). Further specifically, the rear end surface (the end surface arranged on the radially outer side when the toner seal 92 is attached to the inner peripheral wall 83) of the first seal portion 126 projects rearward beyond the rear end surface of the second seal portion 127.

Therefore, the first seal portion 126 can be projected radially outward beyond the second seal portion 127 when the toner seal 92 is attached to the inner peripheral wall 83, without providing the projection 122 on the inner peripheral wall 83.

Eighth Embodiment

Figure 15:
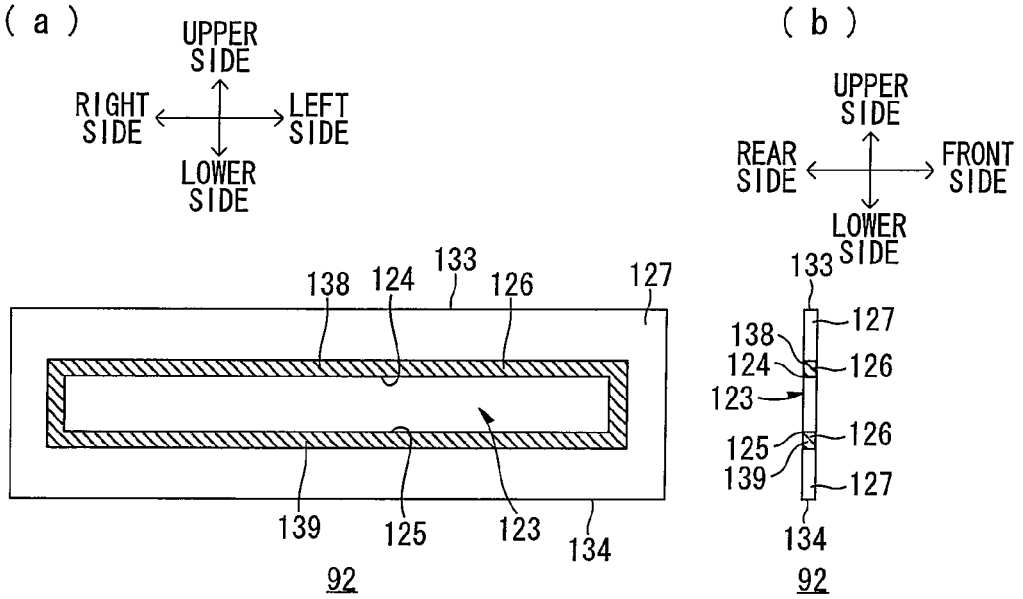
FIG. 15(*a*) is a rear elevational view of a toner seal according to an eighth embodiment.

FIG. 15(*a*) is a rear elevational view of a toner seal according to an eighth embodiment. FIG. 15(*b*) is a side sectional view of the toner seal according to the eighth embodiment.

In each of the aforementioned embodiments, the first seal portion 126 is projected radially outward beyond the second seal portion 127 when the toner seal 92 is attached to the inner peripheral wall 83, in order to make the contact pressure of the first seal portion 126 to the outer peripheral wall 101 higher than the contact pressure of the second seal portion 127 to the outer peripheral wall 101. For this purpose, the projection 122 is provided on the inner-side edge 135, or the toner seal 92 is so formed that the thickness of the first seal portion 126 is larger than that of the second seal portion 127.

Alternatively, the rigidity of the first seal portion 126 (shown by slanted lines in FIG. 15(*a*)) may be made higher than that of the second seal portion 127 while keeping the thickness of the toner seal 92 uniform, as shown in FIGS. 15(*a*) and 15(*b*).

In this case, referring to FIG. 12(*b*), the restoring force of the first seal portion 126 compressed between the outer peripheral wall 101 and the inner peripheral wall 83 is larger than the restoring force of the second seal portion 127. In other words, the contact pressure of the first seal portion 126 to the outer peripheral wall 101 can be made higher than the contact pressure of the second seal portion 127 to the outer peripheral wall 101.

Ninth Embodiment

Figure 16:
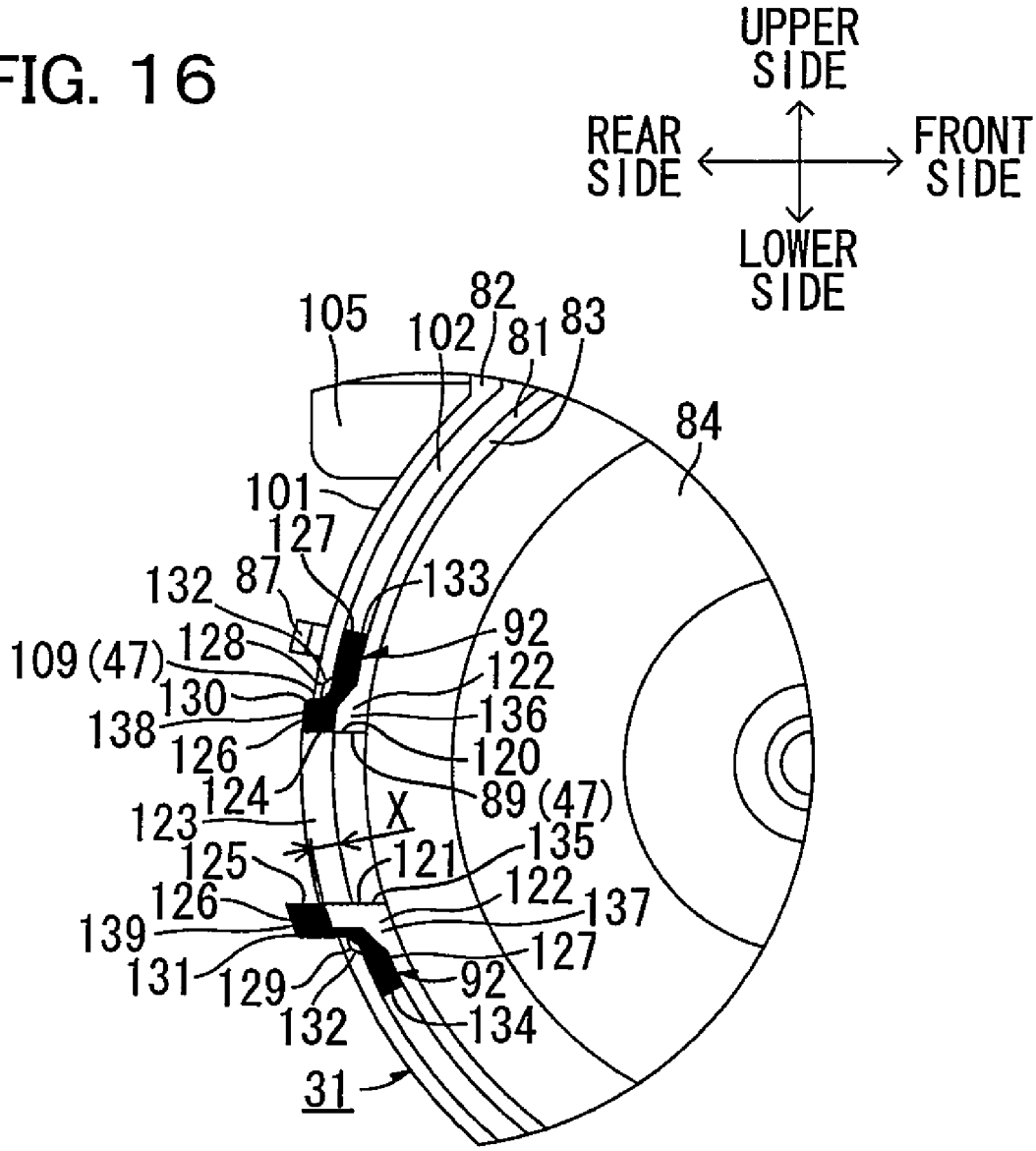
FIG. 16 illustrates a ninth embodiment applied to FIG. 10(*b*).

FIG. 16 illustrates a ninth embodiment applied to FIG. 10(*b*). FIG. 16 shows a toner seal in a filled manner, for the convenience of illustration.

As shown in FIG. 16, the projection lower portion 137 of the projection 122 may project in the projecting direction (radially outward direction) by a predetermined amount X beyond the projection upper portion 136. When the inner passing port 89 is opened, therefore, the seal lower portion 139 arranged on the projection lower portion 137 projects radially outward of the outer peripheral wall 101 beyond the seal upper portion 138 arranged on the projection upper portion 136.

Thus, the contact pressure of the seal lower portion 139 to the process frame 22 (more specifically, the shutter 68) is higher than the contact pressure of the seal upper portion 138 to the process frame 22 in the place where the toner cartridge 31 is attached in the process frame 22. Therefore, at least the seal lower portion 139 can be reliably brought into contact with the process frame 22. Consequently, downward leakage of the toner from the inner passing port 89 can be prevented between the inner passing port 89 and the process cartridge 17 (more specifically, the process frame 22).

Alternatively, the rigidity of the seal lower portion 139 may be made higher than the rigidity of the seal upper portion 138 while keeping the amount of projection of the projection lower portion 137 identical to that of the projection upper portion 136 and keeping the thickness of the toner seal 92 uniform.

In this case, the restoring force of the seal lower portion 139 pressed against the process frame 22 (more specifically, the shutter 68) is larger than the restoring force of the seal upper portion 138. In other words, the contact pressure of the seal lower portion 139 to the process frame 22 can be made higher than the contact pressure of the seal upper portion 138 to the process frame 22. Thus, downward leakage of the toner from the inner passing port 89 can be reliably prevented between the inner passing port 89 and the process cartridge 17 (more specifically, the process frame 22 and the shutter 68).

Tenth Embodiment

In the aforementioned embodiment, while the inner casing 81 is pivoted from the closed position to the open position so that each inner passing port 89 lowers toward the corresponding outer passing port 109, the inner casing 81 may alternatively be pivoted from the closed position to the open position so that the inner passing port 89 rises toward the outer passing port 109.

While the inner casing 81 is pivoted with respect to the outer casing 82 in the aforementioned embodiment, the outer casing 82 may alternatively be rotated with respect to the inner casing 81. More specifically, the outer casing 82 is pivoted between the open position and the closed position, and the inner passing port 89 is opposed to the outer passing port 109 and opened when the outer casing 82 is on the open position, and the inner passing port 89 is closed by a portion of the outer peripheral wall 101 other than the outer passing port 109 when the outer casing 82 is on the closed position.

Further, the toner cartridge 31 may not have the double structure in which the outer casing 82 receives the inner casing 81. In this case, the outer casing 82 may be formed as a shutter arranged on the outer side of the inner casing 81 and slidable with respect to the outer peripheral surface of the inner peripheral wall 83. If the outer casing 82 is formed as a shutter, each inner passing port 89 can be opened by simply shifting the outer casing 82 itself from the inner passing port 89 without opening the inner passing port 89 by opposing the corresponding outer passing port 109 thereto, whereby the outer casing 82 may not be provided with the outer passing port 109.

In order to project each first seal portion 126 radially outward of the outer peripheral wall 101 when the inner passing port 89 is opened, the toner seal 92 may be provided not on the inner casing 81 but on the outer casing 82. In this case, the toner seal 92 is attached to the inner peripheral surface of the outer peripheral wall 101, to expose the first seal portion 126 in the corresponding outer passing port 109. Thus, when the inner passing port 89 is opposed to the outer passing port 109, the first seal portion 126 exposed in the outer passing port 109 is pressed by the projection 122 provided on the edge of the inner passing port 89, to project outward of the outer peripheral wall 101. Also in this case, the inner casing 81 may be pivoted with respect to the outer casing 82, or the outer casing 82 may be pivoted with respect to the inner casing 81, as a matter of course.

In order to more compress the first seal portion 126 than the second seal portion 127 between the outer peripheral wall 101 and the inner peripheral wall 83, the projection 122 may be provided not on the inner casing 81 but on the outer casing 82. In this case, the projection 122 is provided on the inner peripheral surface of the outer peripheral wall 101, to project radially inwardly of the outer peripheral wall 101 (toward the outer peripheral surface of the inner peripheral wall 83). The toner seal 92 is attached to the inner peripheral surface of the outer peripheral wall 101, so that the first seal portion 126 is arranged on the projection 122. Thus, when the inner casing 81 is received in the outer casing 82, the first seal portion 126 is pressed by the projection 122 against the outer peripheral surface of the inner peripheral wall 83, to be more compressed between the outer peripheral wall 101 and the inner peripheral wall 83 than the second seal portion 127. In other words, the contact pressure of the first seal portion 126 to the outer peripheral surface of the inner peripheral wall 83 can be made higher than the contact pressure of the second seal portion 127 to the outer peripheral surface of the inner peripheral wall 83 in this state. The projection 122 may be provided on either one of the outer peripheral wall 101 and the inner peripheral wall 83, and the toner seal 92 may be provided on the other one of the outer peripheral wall 101 and the inner peripheral wall 83. Further, the inner casing 81 may be pivoted with respect to the outer casing 82, or the outer casing 82 may be pivoted with respect to the inner casing 81. In any case, the first seal portion 126 may be arranged on the edge (the inner-side edge 135) of the inner passing port 89 and the second seal portion 127 may be arranged on a position separated from the inner passing port 89 beyond the first seal portion 126 when the outer casing 82 closes the inner passing port 89. Thus, reduction of the operability for opening/closing the inner passing port 89 can be suppressed while preventing leakage of the toner from the inner passing port 89.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A toner cartridge comprising:

a first frame storing a developing agent and having a first opening for passing the developing agent therethrough in a direction of passing, the direction of passing being perpendicular to a plane of the first opening;

a second frame relatively movable with respect to the first frame in a direction orthogonal to a direction of passage of the developing agent through the first opening, and opening/closing the first opening; and a seal member provided on either one of the first frame and the second frame for coming into contact with the other frame to prevent leakage of the developing agent from the first opening, wherein a first edge of the seal member and an edge of the other frame contact each other when the second frame opens/closes the first opening, and, wherein at least part of the contact between the first edge of the seal member and the edge of the other frame extends in the direction of passing.

2. The toner cartridge according to claim 1, wherein the seal member is provided on the first frame, the second frame is formed with a second opening for opening the first opening when opposed to the first opening, the first edge and a second edge of the second opening of the second frame, coming into contact with each other when the second frame opens/closes the first opening, intersect with each other as viewed from the direction of passage, and the second edge is inclined from an upstream side toward a downstream side in a direction of relative movement of the first edge as viewed from the direction of passage when the second frame opens/closes the first opening.

3. The toner cartridge according to claim 2, wherein the second edge is inclined to be recessed in a V-shaped manner from the upstream side toward the downstream side in the direction of relative movement of the first edge as viewed from the direction of passage when the second frame opens/closes the first opening.

4. The toner cartridge according to claim 2, wherein the first edge is provided along an edge of the first opening, and the first edge is arranged separately from the second edge in the second opening as viewed from the direction of passage in a state where the first opening and the second opening are opposed to each other.

5. The toner cartridge according to claim 4, wherein the second frame is arranged on an outer side of the first frame, the seal member includes a first seal portion formed with the first edge and arranged on the edge of the first opening and a second seal portion arranged on a position separated from the first opening beyond the first seal portion, the toner cartridge comprises a projection provided on a peripheral edge of the first opening in the first frame to project toward the second frame for pressing the first seal portion against the second frame, and the first seal portion is positioned on an outer side of the second frame in a projecting direction of the projection when the second frame opens the first opening.

6. A developing apparatus comprising:

a toner cartridge storing a developing agent and a casing to which the toner cartridge is detachably mountable, wherein the toner cartridge includes:

a first frame storing the developing agent and having a first opening for passing the developing agent therethrough in a direction of passing, the direction of passing being perpendicular to a plane of the first opening;

a second frame relatively movable with respect to the first frame in a direction orthogonal to a direction of passage of the developing agent through the first opening, and opening/closing the first opening; and a seal member provided on either one of the first frame and the second frame for coming into contact with the other frame to prevent leakage of the developing agent from the first opening, wherein a first edge of the seal member and an edge of the other frame contact each other when the second frame opens/closes the first opening, wherein at least part of the contact between the first edge of the seal member and the edge of the other frame extends in the direction of passing, wherein the second frame is formed with a second opening, and wherein the casing is formed with a third opening opposed to the first opening and capable of receiving the developing agent.

7. The developing apparatus according to claim 6, wherein the seal member is provided on the first frame, the second opening is configured to open the first opening when opposed to the first opening, the first edge and a second edge of the second opening of the second frame, coming into contact with each other when the second frame opens/closes the first opening, intersect with each other as viewed from the direction of passage, and the second edge is inclined from an upstream side toward a downstream side in a direction of relative movement of the first edge as viewed from the direction of passage when the second frame opens/closes the first opening.

8. The developing apparatus according to claim 7, wherein the second edge is inclined to be recessed in a V-shaped manner from the upstream side toward the downstream side in the direction of relative movement of the first edge as viewed from the direction of passage when the second frame opens/closes the first opening.

9. The developing apparatus according to claim 7, wherein the first edge is provided along an edge of the first opening, and the first edge is arranged separately from the second edge in the second opening as viewed from the direction of passage in a state where the first opening and the second opening are opposed to each other.

10. The developing apparatus according to claim 9, wherein the second frame is arranged on an outer side of the first frame, the seal member includes a first seal portion formed with the first edge and arranged on the edge of the first opening and a second seal portion arranged on a position separated from the first opening beyond the first seal portion, the developing apparatus comprises a projection provided on a peripheral edge of the first opening in the first frame to project toward the second frame for pressing the first seal portion against the second frame, and the first seal portion is positioned on an outer side of the second frame in a projecting direction of the projection when the second frame opens the first opening.

11. A toner cartridge comprising:

a first frame storing a developing agent and having a first opening for passing the developing agent therethrough;

a second frame opening/closing the first opening; and a seal member provided on either one of the first frame and the second frame for coming into contact with the other frame to prevent leakage of the developing agent from the first opening, wherein the first frame has a first edge portion forming the first opening, the seal member includes a first seal portion arranged on the first edge portion when the second frame closes the first opening and a second seal portion arranged on a position separated from the first opening beyond the first seal portion when the second frame closes the first opening, and a contact pressure of the first seal portion to the other frame is higher than a contact pressure of the second seal portion to the other frame.

12. The toner cartridge according to claim 11, comprising a projection provided on either one of the first frame and the second frame to project toward the other frame for pressing the first seal portion against the other frame.

13. The toner cartridge according to claim 12, wherein the projection is provided on the first edge portion in the first frame.

14. The toner cartridge according to claim 13, wherein the second frame is arranged on an outer side of the first frame, and the first seal portion is positioned on an outer side of the second frame in a projecting direction of the projection when the second frame opens the first opening.

15. The toner cartridge according to claim 14, wherein the second frame receives the first frame, the first frame and the second frame are relatively movable with respect to each other, and the second frame is formed with a second opening larger than the first opening for opening the first opening when opposed to the first opening.

16. The toner cartridge according to claim 13, wherein the projection is provided along an entire periphery of the first edge portion.

17. The toner cartridge according to claim 13, wherein the seal member is provided on the first frame such that the first seal portion is arranged on the projection.

18. A developing apparatus comprising:

a toner cartridge storing a developing agent and a casing to which the toner cartridge is detachably mountable, wherein wherein the toner cartridge includes:

a first frame storing the developing agent and having a first opening for passing the developing agent therethrough;

a second frame opening/closing the first opening; and a seal member provided on either one of the first frame and the second frame for coming into contact with the other frame to prevent leakage of the developing agent from the first opening, wherein the first frame has a first edge portion forming the first opening, wherein the seal member includes a first seal portion arranged on the first edge portion when the second frame closes the first opening and a second seal portion arranged on a position separated from the first opening beyond the first seal portion when the second frame closes the first opening, wherein a contact pressure of the first seal portion to the other frame is higher than a contact pressure of the second seal portion to the other frame, wherein the second frame is formed with a second opening, and wherein the casing is formed with a third opening opposed to the first opening and capable of receiving the developing agent.

19. The developing apparatus according to claim 18, further comprising a projection provided on either one of the first frame and the second frame to project toward the other frame for pressing the first seal portion against the other frame.

20. The developing apparatus according to claim 19, wherein the projection is provided on the first edge portion in the first frame.

21. The developing apparatus according to claim 20, wherein the second frame is arranged on an outer side of the first frame, and the first seal portion is positioned on an outer side of the second frame in a projecting direction of the projection when the second frame opens the first opening.

22. The developing apparatus according to claim 21, wherein the second frame receives the first frame, the first frame and the second frame are relatively movable with respect to each other, and the second frame is formed with a second opening larger than the first opening for opening the first opening when opposed to the first opening.

23. The developing apparatus according to claim 21, wherein the projection is provided along an entire periphery of the first edge portion.

24. The developing apparatus according to claim 21, wherein the seal member is provided on the first frame such that the first seal portion is arranged on the projection.

25. The developing apparatus according to claim 21, wherein the first seal portion is in contact with the casing in a state where the toner cartridge is attached in the casing.

26. The developing apparatus according to claim 25, wherein a portion of the projection located under the first opening projects in the projecting direction beyond a portion of the projection located above the first opening in the state where the toner cartridge is attached in the casing.

27. The developing apparatus according to claim 18, wherein the first seal portion is in contact with the casing in a state where the toner cartridge is attached in the casing, and a contact pressure of a portion of the first seal portion located under the first opening to the casing is higher than a contact pressure of a portion of the first seal portion located above the first opening to the casing.

* * * * *